US007726772B2

(12) United States Patent
Yamamoto

(10) Patent No.: US 7,726,772 B2
(45) Date of Patent: Jun. 1, 2010

(54) LIQUID EJECTION APPARATUS

(75) Inventor: Taisuke Yamamoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 679 days.

(21) Appl. No.: 11/655,210

(22) Filed: Jan. 19, 2007

(65) Prior Publication Data

US 2007/0171252 A1 Jul. 26, 2007

(30) Foreign Application Priority Data

Jan. 20, 2006 (JP) ..... 2006-012592

(51) Int. Cl.
*B41J 2/165* (2006.01)

(52) U.S. Cl. ..... 347/35; 347/29; 347/32

(58) Field of Classification Search ..... 347/29–33, 347/35

See application file for complete search history.

(56) References Cited

U.S. PATENT DOCUMENTS 5,270,738 A * 12/1993 Takahashi et al. ..... 347/24
5,663,751 A * 9/1997 Holbrook ..... 347/22
6,328,412 B1 * 12/2001 Taylor et al. ..... 347/32
6,578,945 B2 * 6/2003 Hashi et al. ..... 347/22
7,341,328 B2 * 3/2008 Berry et al. ..... 347/29
7,393,080 B2 * 7/2008 Ishikawa ..... 347/29

FOREIGN PATENT DOCUMENTS

JP 2002-086759 A 3/2002
JP 2002-086762 A 3/2002
JP 2002-361905 A 12/2002

* cited by examiner

*Primary Examiner*—Shih-Wen Hsieh
(74) *Attorney, Agent, or Firm*—Sughrue Mion, PLLC

(57) ABSTRACT

A liquid ejection apparatus including a liquid ejection head, a liquid receiver, a liquid receiver movement mechanism, and a lid body is provided. The liquid ejection head has a nozzle surface. The nozzle surface includes a nozzle opening. The liquid ejection head ejects a liquid from the nozzle surface. The liquid receiver has an opening provided in correspondence with the nozzle surface of the liquid ejection head. The liquid receiver is capable of receiving the liquid ejected as a waste liquid from the nozzle opening of the liquid ejection head through the opening of the liquid receiver. The liquid receiver movement mechanism moves the liquid receiver between a receiving position at which the opening of the liquid receiver opposes the nozzle surface of the liquid ejection head and a non-receiving position spaced from the receiving position. The lid body is arranged at the non-receiving position. The lid body contacts the liquid receiver in such a manner as to close the opening of the liquid receiver after the liquid receiver is moved to the non-receiving position by the liquid receiver movement mechanism.

11 Claims, 11 Drawing Sheets

LIQUID EJECTION APPARATUS

CROSS-REFERENCE TO RELATED APPLICATIONS

This application is based upon and claims the benefit of priority from prior Japanese Patent Application No. 2006-012592, filed on Jan. 20, 2006, the entire contents of which is incorporated herein by reference.

FIELD OF THE INVENTION

The present invention relates to a liquid ejection apparatus.

BACKGROUND

An inkjet printer is generally known as a liquid ejection apparatus that ejects liquid, which is ink, onto a target from nozzle openings defined in a nozzle surface of a recording head. The printer wipes off ink from the nozzle surface using a wiper as a part of maintenance operation performed on the recording head. Such wiping may cause variation in the meniscus of the ink in the nozzle openings. Further, if the amount of ink ejected for printing by a certain one of the nozzle openings is relatively small compared to those of the other openings, the viscosity of the ink may increase in that nozzle opening, thus clogging the nozzle opening. To prevent the variation in the meniscuses of the ink in the nozzle openings and suppress nozzle clogging, flushing, or forcible ink ejection, is preformed on the nozzle openings by the printer in response to a drive signal unrelated to printing. The ejected ink is received in a flushing box that is shaped like a box with a closed bottom, or a liquid receiver. As described in JP-A-2002-86762, in flushing, the flushing box is arranged in a flushing area opposed to a cap member, which seals the nozzle surface of the recording head in cleaning, with a printing area arranged between the flushing area and the cap member.

After having been discharged from the nozzle openings of the recording head into the flushing box, the ink is normally absorbed in and retained by an ink absorbing material accommodated in the flushing box. However, since various types of ink are now used, there may be cases in which the ink containing solvent that easily evaporates, such as pigment ink, is employed. In these cases, the ink solidifies through evaporation of the solvent and thus clogs pores of the ink absorbing material or deposits on the ink absorbing material. To suppress such evaporation of the ink, JP-A-2002-86759, for example, proposes a printer in which an opening of a flushing box is closed by a lid body when flushing is not performed.

Specifically, in the printer of JP-A-2002-86759, the flushing box has an upper opening and is provided in a fixed state in the flushing area, as in the printer of JP-A-2002-86762. Further, the printer of JP-A-2002-86759 includes a lid body arranged on the opening of the flushing box. The lid body is slidable between a closing position at which the lid body closes the opening of the flushing box and a non-closing position spaced sideways from the closing position. When the lid body is located at the non-closing position, the opening of the flushing box is maintained in an open state. The lid body is normally maintained at the closing position by the urging force of a spring member. When a carriage carrying a recording head is arranged above the flushing box, a portion of the carriage contacts the lid body. The carriage thus urges the lid body to move from the closing position to the non-closing position against the urging force of the spring member. This opens the opening of the flushing box.

The printer of JP-A-2002-86762 and the printer of JP-A-2002-86759 each have the flushing area, in which the flushing box is fixed, at the position opposed to the cap member with the printing area located between the flushing area and the cap member. This increases the dimension of each of the printers as a while in the movement direction of the carriage by the margin corresponding to the space occupied by flushing area. The printers thus do not satisfy a need for saving space in the printers.

Also, in the printer of JP-A-2002-86759, which suppresses evaporation of the ink from the flushing box, the carriage is moved from the printing area to the flushing area in order to perform flushing. The carriage then presses the lid body separately from the printing area. This further increases the dimension of the printer as a whole in the movement direction of the carriage by the margin corresponding to the distance covered by the movement of the lid body.

Accordingly, it is an objective of the present invention to provide a liquid ejection apparatus that saves space while suppressing evaporation of liquid from a liquid receiver that receives the liquid ejected from a nozzle opening of a liquid ejection head as waste liquid.

SUMMARY

Accordingly, it is an objective of the present invention to provide a liquid ejection apparatus including a liquid ejection head, a liquid receiver, a liquid receiver movement mechanism, and a lid body. The liquid ejection head has a nozzle surface. The nozzle surface includes a nozzle opening. The liquid ejection head ejects a liquid from the nozzle surface. The liquid receiver has an opening provided in correspondence with the nozzle surface of the liquid ejection head. The liquid receiver is capable of receiving the liquid ejected as a waste liquid from the nozzle opening of the liquid ejection head through the opening of the liquid receiver. The liquid receiver movement mechanism moves the liquid receiver between a receiving position at which the opening of the liquid receiver opposes the nozzle surface of the liquid ejection head and a non-receiving position spaced from the receiving position. The lid body is arranged at the non-receiving position. The lid body contacts the liquid receiver in such a manner as to close the opening of the liquid receiver after the liquid receiver is moved to the non-receiving position by the liquid receiver movement mechanism.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

An inkjet printer according to an embodiment of a liquid ejection apparatus of the present invention will now be described with reference to the attached drawings.

In the description, the directions "upward", "downward", "right", and "left" will refer to the directions indicated by the corresponding arrows of the drawings.

Figure 1:
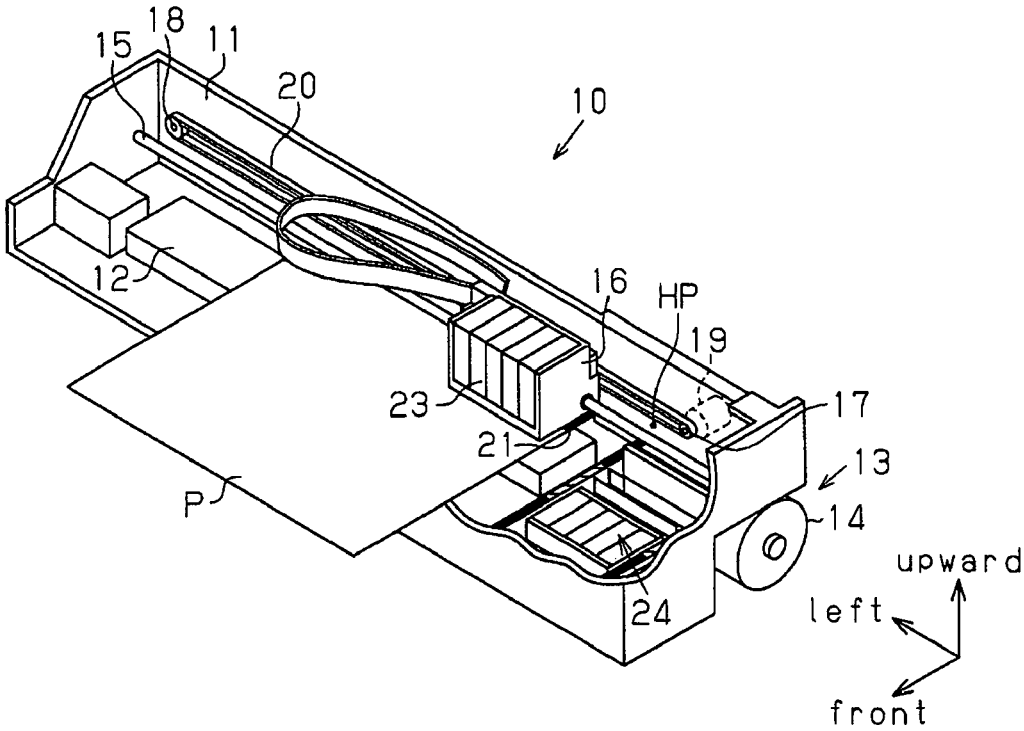
FIG. 1 is a perspective view showing a printer according to an embodiment of the present invention.

As shown in FIG. 1, a printer 10, or a liquid ejection apparatus of the illustrated embodiment, includes a box-like body casing 11. A platen 12 is arranged in a lower portion of the space in the body casing 11 and extends in the longitudinal direction of the body casing 11, or a main scanning direction (a left-and-right direction of FIG. 1). A waste ink tank (not shown) is provided below the platen 12. The platen 12 is a support table that supports a sheet of paper P, which is a target. The platen 12 is driven by the drive force of a paper sending motor 14 of a paper sending mechanism 13 and thus moves the paper sheet P in a sub-scanning direction (a front-and-back direction of FIG. 1) perpendicular to the main scanning direction.

A guide shaft 15 is provided above the platen 12 in the body casing 11 and passes through a carriage 16, thus movably supporting the carriage 16. A drive pulley 17 and a driven pulley 18 are rotatably supported at the positions corresponding to the opposing ends of the guide shaft 15 on a rear surface of the body casing 11. A carriage motor 19 or a drive source that reciprocates the carriage 16 is connected to the drive pulley 17. A timing belt 20 is wound around the two pulleys 17, 18 to fix the carriage 16. This arrangement allows the carriage 16 to move in the main scanning direction through the timing belt 20 while driven by the carriage motor 19 and guided by the guide shaft 15.

Figure 2:
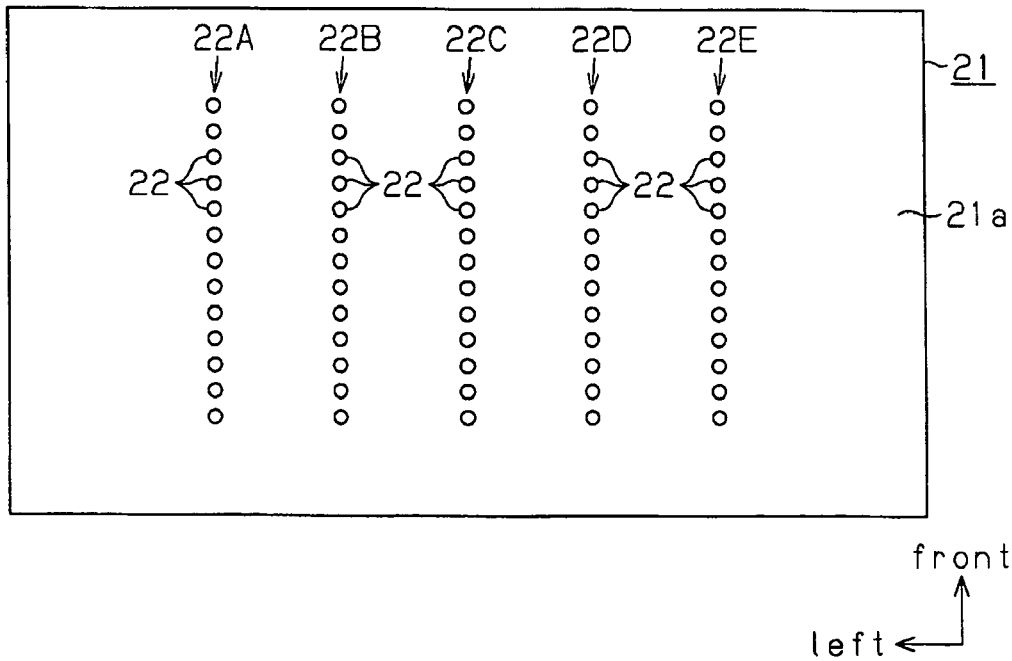
FIG. 2 is a bottom view showing a recording head.

Referring to FIG. 1, a recording head 21, or a liquid ejection head, is provided below the carriage 16. As illustrated in FIG. 2, a plurality of nozzle openings 22 are defined in a lower surface, or a nozzle-forming surface 21*a*, of the recording head 21. The nozzle openings 22 define a plurality of (in FIG. 2, five) nozzle rows 22A, 22B, 22C, 22D, and 22E that are spaced at constant intervals in the left-and-right direction and extend in the front-and-back direction. In the illustrated embodiment, the nozzle row 22E located rightmost in FIG. 2 is defined by the nozzle openings 22 through which black ink is ejected for monochrome printing. The nozzle rows 22A to 22D are each defined by the nozzle openings 22 through which color ink is ejected for color printing.

With reference to FIG. 1, a plurality of (in the illustrated embodiment, five) ink cartridges 23 are removably mounted on the carriage 16. Each of the ink cartridges 23 corresponds to one of the nozzle rows 22A to 22E, which are defined on the nozzle-forming surface 21*a* of the recording head 21. Each ink cartridge 23 supplies ink to the nozzle openings 22 of the associated nozzle rows 22A to 22E through an ink passage (not shown) defined in the recording head 21. In the illustrated embodiment, the ink cartridge 23 located rightmost in FIG. 1 retains the black ink for the monochrome printing and the other ink cartridges 23 each retain a corresponding color ink for the color printing.

A home position HP is defined in a portion (a right portion of FIG. 1) of the space in the body casing 11, or a non-printing area outside the movement range of the paper sheet P. The home position HP is the space in which the carriage 16 stands by when the printer 10 is turned off or maintenance is performed on the nozzle-forming surface 21*a* of the recording head 21. A maintenance unit 24 is provided below the home position HP and carries out various maintenance operations for maintaining effective ink ejection from the recording head 21 to the paper sheet P.

The configuration of the maintenance unit 24 will hereafter be explained in detail with reference to FIGS. 3 to 14.

Figure 3:
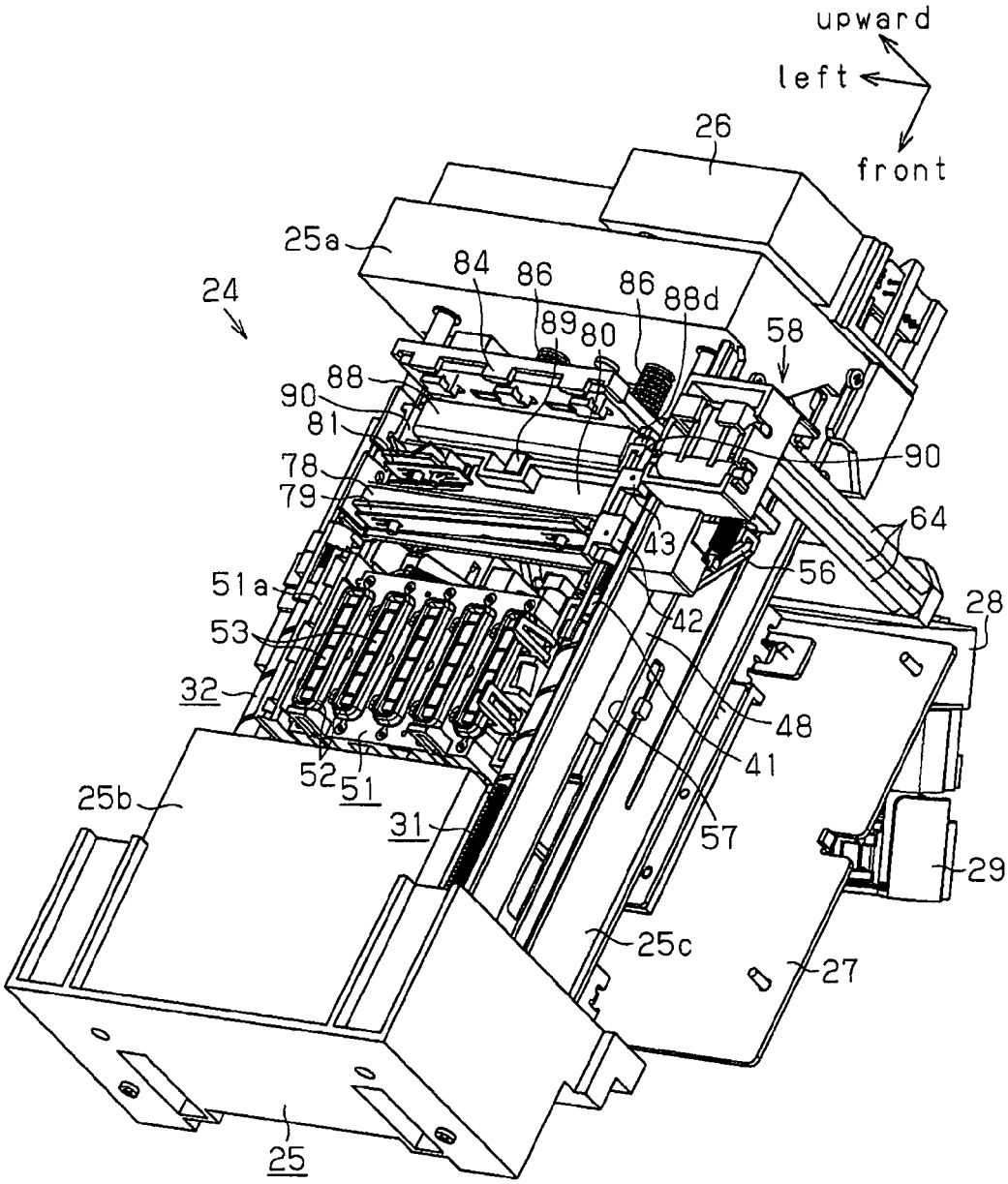
FIG. 3 is a perspective view showing a maintenance unit as viewed from the front right side.
Figure 4:
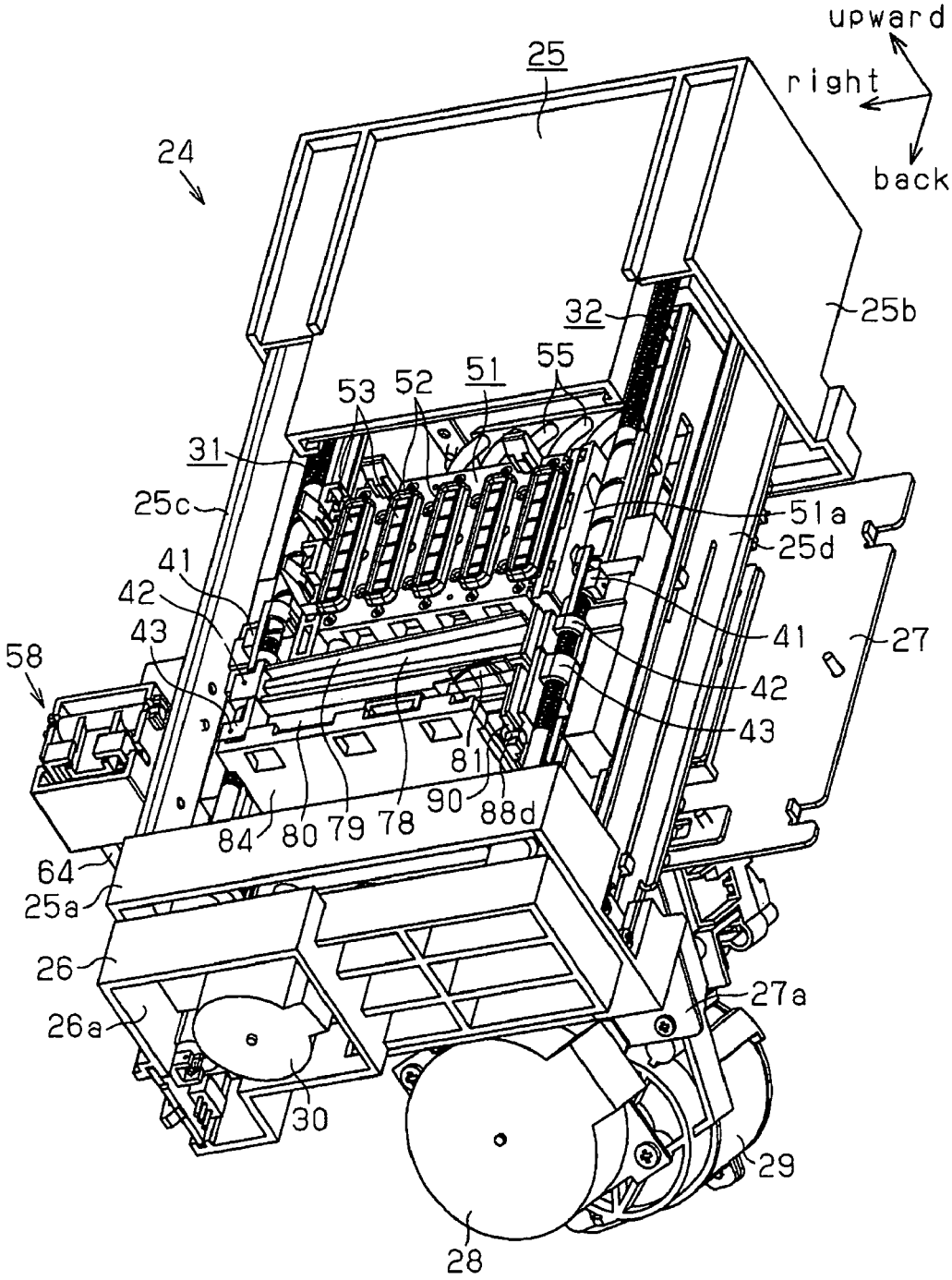
FIG. 4 is a perspective view showing the maintenance unit as viewed from the rear left side.
Figure 5:
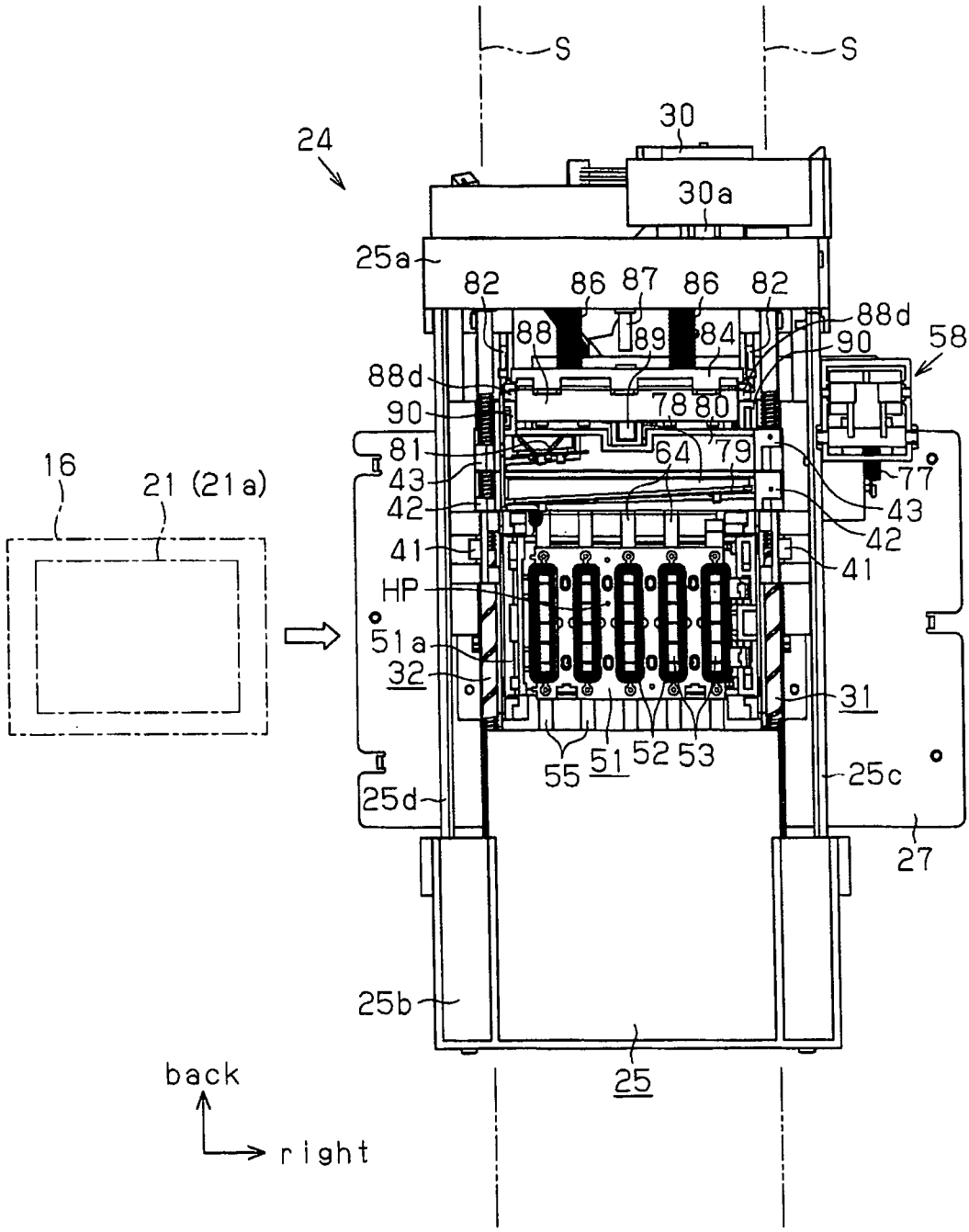
FIG. 5 is a plan view showing the maintenance unit.

With reference to FIGS. 3 to 5, the maintenance unit 24 has a body 25 shaped as a substantially rectangular frame. The body 25 includes a rear casing 25*a*, a front casing 25*b*, a right frame member 25*c*, and a left frame member 25*d*.

The rear casing 25*a* has a substantially box-like shape and has a rear opening. The front casing 25*b* has also a box-like shape but larger-sized and has a rear opening. The front-and-back dimension of the front casing 25*b* is greater than that of the rear casing 25*a*. The right frame member 25*c* connects the casings 25*a*, 25*b* to each other at their respective right ends. The left frame member 25*d* connects the casings 25*a*, 25*b* to each other at their respective left ends. A sub casing 26 is secured to the rear side of the rear casing 25*a* in such a manner as to close the rear opening of the rear casing 25*a*.

Referring to FIG. 4, the right half of the space in the sub casing 26 defines a motor receiving recess 26*a* (see FIG. 4).

Figure 6:
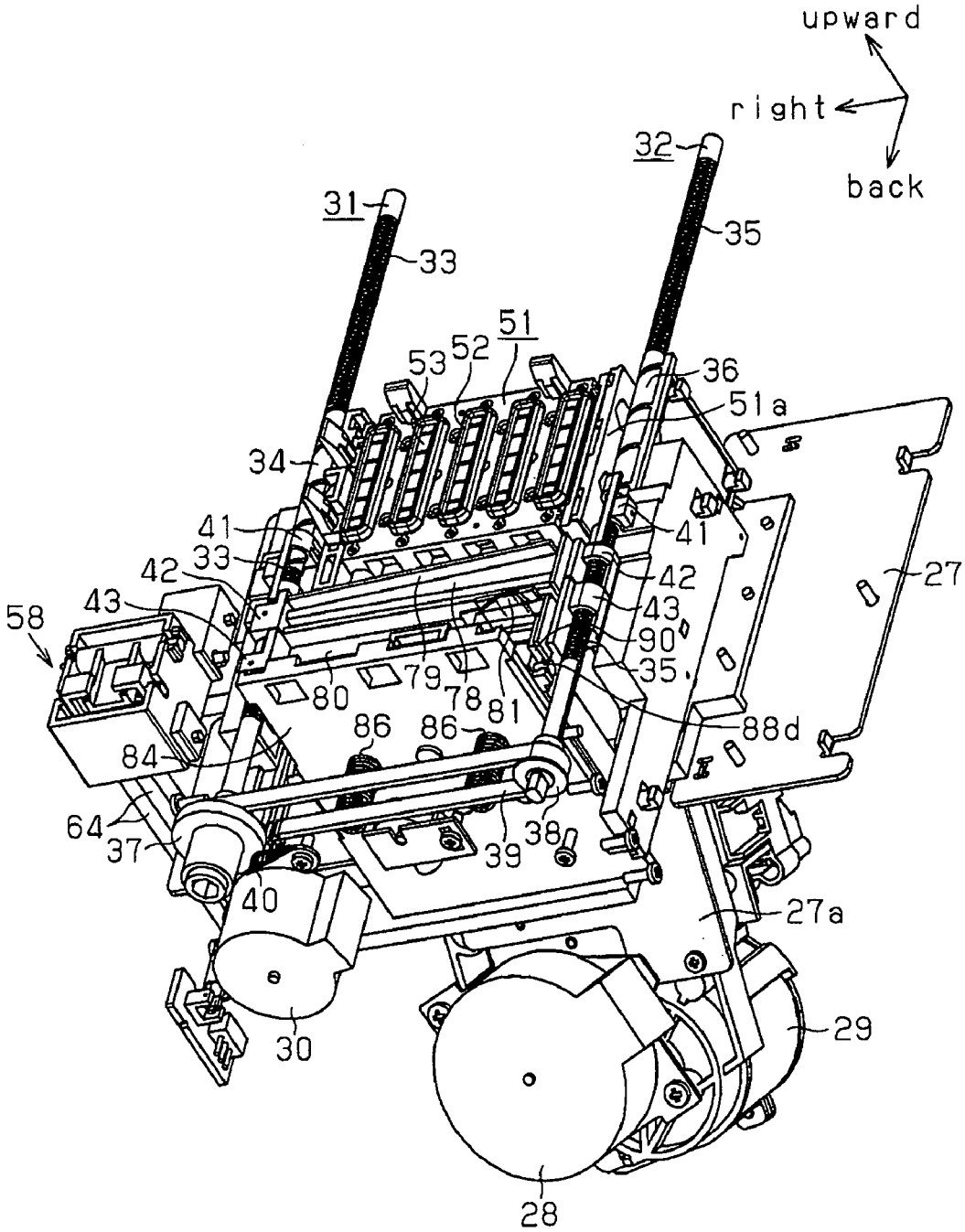
FIG. 6 is a perspective view showing the configuration of the interior of the body of the maintenance unit.

Referring to FIGS. 3 to 5, an attachment plate 27 is arranged below the body 25 and fixed in a horizontal state. The left-and-right dimension of the attachment plate 27 is greater than the dimension of the body 25. With reference to FIGS. 4 and 6, a pump motor 28 and a suction pump 29 formed by a tube pump is supported by the attachment plate 27 through an attachment bracket 27*a* in an inclined state. The suction pump 29 serves as a suction drainage device. The attachment plate 27 is supported by the body casing 11 through a securing member (not shown). In this manner, as illustrated in FIG. 1, the maintenance unit 24 is held in a fixed state at a position below the home position HP in the body casing 11.

As shown in FIGS. 4 and 5, a drive motor 30 is secured to a wall of the motor receiving recess 26*a* of the sub casing 26. The drive motor 30 serves as a drive source and is selectively rotatable in a forward direction and a reverse direction. Referring to FIG. 5, an output shaft 30*a* of the drive motor 30 extends through the sub casing 26 and projects forward. The distal end of the output shaft 30*a* is arranged in the rear casing 25*a*.

Figure 7:
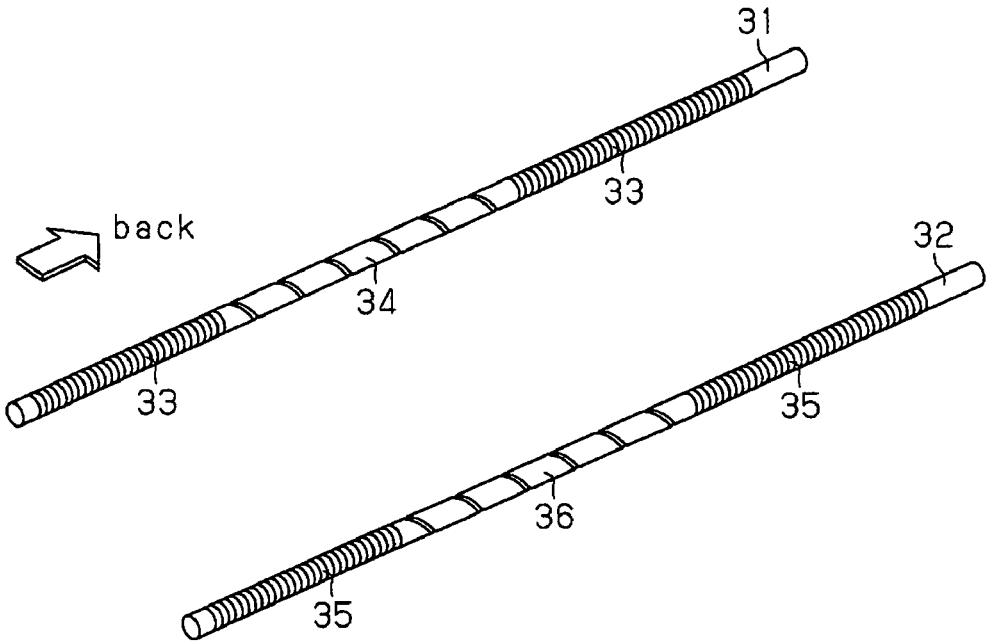
FIG. 7 is a perspective view showing lead screws.

As shown in FIGS. 3 to 5, a right lead screw 31 and a left lead screw 32 are rotatably provided between the rear casing 25*a* and the front casing 25*b* of the body 25. The right lead screw 31 is located above and inward from the right frame member 25*c*, extending horizontally along the front-and-back direction. The left lead screw 32 is located above and inward from the left frame member 25*d*, extending horizontally along the front-and-back direction. The right and left lead screws 31, 32 each form a drive force transmission member and a sending member. Referring to FIG. 7, the right lead screw 31 has first threaded sending portions 33 formed on the outer circumferential surfaces of the longitudinal front and rear end portions of the lead screw 31. The right lead screw 31 also has a second threaded sending portion 34 formed on the outer circumferential surface of a substantial longitudinal middle portion of the lead screw 31. Similarly, the left lead screw 32 has first threaded sending portions 35 formed on the outer circumferential surfaces of the longitudinal front and rear end portions of the lead screw 32 and a second threaded sending portion 36 formed on the outer circumferential surface of a substantial longitudinal middle portion of the lead screw 32. The pitch of each of the first threaded sending portions 33, 35 is smaller than the pitch of each of the second threaded sending portions 34, 36. The rear end of the right lead screw 31 and the rear end of the left lead screw 32 are received in the rear casing 25*a*.

FIG. 6 shows the maintenance unit 24 of FIG. 4 without the body 25 and the sub casing 26. Synchronous pulleys 37 and a synchronous pulley 38 are secured to the rear end of the lead screw 31 and the rear end of the lead screw 32, respectively. An endless pinion belt 39 is wound around the pulleys 37, 38. The pulley 37, which is secured to the rear end of the right lead screw 31, is connected to the distal end of the output shaft 30*a* of the drive motor 30 through a transmission gear 40 in such a manner as to allow transmission of the drive force. Therefore, when the drive motor 30 runs and generates the drive force, the right and left lead screws 31, 32 synchronously rotate in the same directions about the corresponding axes S (see FIG. 5).

Figure 8:
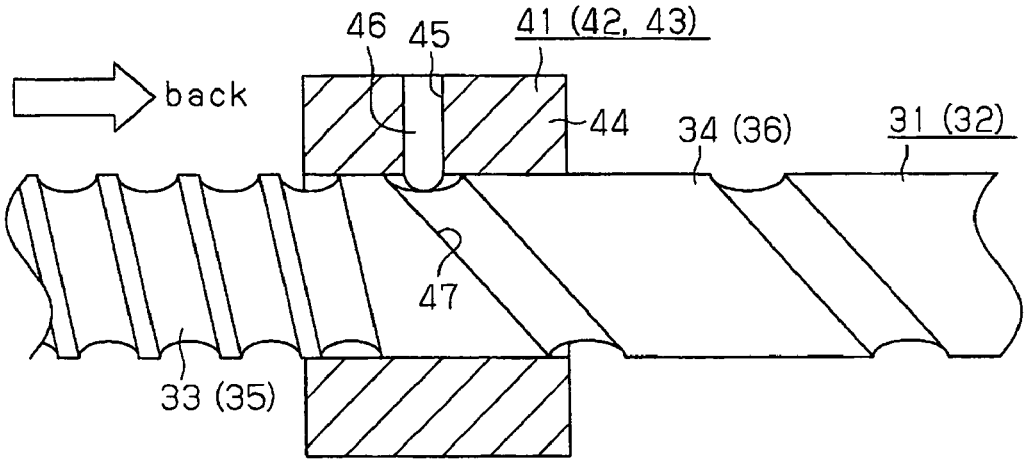
FIG. 8 is a cross-sectional view showing the lead screw and a cylindrical portion of a movable member in a mutually engaged state.

With reference to FIGS. 3 to 6, a plurality of movable members 41, 42 and 43 are provided around each of the right and left lead screws 31, 32 along the direction of the axes S. In the illustrated embodiment, a total of six movable members, which are two movable members 41, two movable members 42, and two movable members 43, in pairs, are employed. In other words, each of the movable members 41, the associated one of the movable members 42, and the associated one of the movable members 43 are arranged around the common one of the lead screws 31, 32. With reference to FIG. 8, each of the movable members 41, 42 and 43 has a cylindrical portion 44 at which the movable member 41, 42 and 43 is engaged with the corresponding lead screws 31, 32. A bore 45 radially extends through a portion of the cylindrical portion 44. A pin 46, as an engagement portion, is fitted in each of the bores 45.

As illustrated in FIG. 8, the distal end of the pin 46 of each cylindrical portion 44 is engaged with a spiral threaded groove 47, which is provided continuously from the first threaded sending portions 33, 35 to the second threaded sending portion 34, 36 of the associated lead screws 31, 32. The pins 46 are guided by the threaded groove 47 when the lead screws 31, 32 rotate. Thus, each pair of the movable members 41, 42 and 43 move sequentially along the same directions of the axes S of the lead screws 31, 32.

Specifically, the pitch of each threaded groove 47, which guides the corresponding pins 46 while engaged with the pins 46, is varied in the direction of the axis S of the lead screw 31, 32. Therefore, even though the lead screws 31, 32 rotate at a constant speed, the movement speed of each of the movable members 41 to 43 is varied in correspondence with variation of the pitch of the threaded grooves 47. That is, as illustrated in FIG. 7, the pitch of each of the first threaded sending portion 33, 35 is smaller than the pitch of each of the second threaded sending portion 34, 36. Accordingly, each movable member 41, 42, 43 moves at a lower speed when moving along the corresponding first threaded sending portion 33, 35 and at a higher speed when moving along the corresponding second threaded sending portion 34, 36.

Each of the movable members 41, the associated one of the movable members 42, and the associated one of the movable members 43 are arranged at separate positions along the direction of the axis S of the corresponding lead screw 31, 32 in such a manner as to prevent two or more of the associated movable members 41 to 43 from becoming engaged with the corresponding second threaded sending portion 34, 36 at the same time. In other words, only one of the associated ones of the movable members 41 to 43 is allowed to become engaged with the corresponding second threaded sending portion 34, 36. For this purpose, the number of the pitches between the pins 46 of each adjacent pair of the movable members 41 to 43 in the direction of the axis S of the lead screw 31, 32 is greater than the number of the pitches of each second threaded sending portion 34, 36. Thus, while one of the associated movable members 41, 42, 43 is engaged with the second threaded sending portion 34, 36 through rotation of the lead screw 31, 32, the other two of the movable members 41 to 43 are prevented from becoming engaged with the second threaded sending portion 34, 36. Accordingly, only the one of the movable members 41 to 43 that is engaged with the second threaded sending portion 34, 36 moves at an increased speed.

In the illustrated embodiment, when the drive motor 30 runs in the forward direction, each of the lead screws 31, 32 rotates in a forward direction in such a manner that the movable members 41 to 43 then proceed from the rear casing 25*a* toward the front casing 25*b*. Contrastingly, when the drive motor 30 rotates in the reverse direction, each lead screw 31, 32 rotates in a reverse direction in such a manner that the movable members 41 to 43 retreat from the front casing 25*b* toward the rear casing 25*a*. In the illustrated embodiment, the lead screws 31, 32 and the movable members 41 to 43 form a drive force transmission device. Particularly, the lead screws 31, 32 and the movable members 43 form a liquid receiver movement mechanism.

The movable members 41, which are located foremost of the movable members 41 to 43 in the directions of the axes S of the lead screws 31, 32, are provided for moving a cap member 51 and a valve body 66, which will be explained later. The movable members 41 transmit the drive force produced through rotation of the lead screws 31, 32 to the cap member 51 and the valve body 66. The movable members 42, which are located the second foremost in the directions of the axes S of the lead screws 31, 32, are employed for moving a wiper 79, which will be explained later. The movable members 42 transmit the drive force generated through rotation of the lead screws 31, 32 to the wiper 79. The movable members 43, which are located rearmost in the directions of the axes S of the lead screws 31, 32, are provided form moving the wiper 81 and a flushing box 88, which will be explained later. The movable members 43 transmit the drive force generated through rotation of the lead screws 31, 32 to the wiper 81 and the flushing box 88.

First, the movable members 41, which move the cap member 51 and the valve body 66, will be explained.

As shown in FIGS. 9A to 11B, a substantially rectangular plate 48, which extends in the front-and-back direction, is formed integrally with each of the movable members 41. Each of the plates 48 extends downward from the associated one of the movable members 41 at a position inward from the corresponding one of the right and left frame members 25*c*, 25*d*. An elongated guide bore 49 is defined in each plate 48 and serves as an associating portion through which the associated movable member 41 associates with the cap member. With reference to FIGS. 9A to 11B, each of the guide bores 49 has a rear horizontal portion 49*a*, a diagonal portion 49*b*, and a front horizontal portion 49*c*. The rear horizontal portion 49*a* extends horizontally from a lower portion at the rear end to a substantial middle portion of the plate 48 in the fore-and-back direction of the plate 48. The diagonal portion 49*b* extends diagonally from the front end of the rear horizontal portion 49*a* toward the vicinity of an upper portion at the front end of the plate 48. The front horizontal portion 49*c* extends horizontally from the front end of the diagonal portion 49*b* to the upper portion at the front end of the plate 48.

Referring to FIGS. 9A to 11B, a holder member 50, which is shaped like a rectangular frame and has an upper opening, is provided inward from the plates 48 and at the positions corresponding to the second threaded sending portions 34, 36 of the lead screws 31, 32. A cap member 51 is received in the holder member 50 in a state accommodated in a cap holder 51*a* shaped like a box having a closed bottom. In this state, the cap member 51 is movable in the up-and-down direction together with the cap holder 51*a*. A coil spring (not shown) is arranged between a lower surface of the cap member 51 and an inner bottom surface of the cap holder 51*a* in such a manner as to urge the cap member 51 upward. In FIGS. 9A to 11B, the maintenance unit 24 is schematically illustrated as viewed from the left side. Therefore, only the left lead screw 32 and the associated threaded sending portions 35, 36 are shown in the drawings.

The cap member 51 will hereafter be explained.

With reference to FIGS. 3 to 6 and 9 to 11, the cap member 51 has a substantially rectangular box shape. A plurality of (in the illustrated embodiment, five) rectangular seal portions 52 are formed on an upper surface of the cap member 51. Each of the seal portions 52 corresponds to one of the nozzle rows 22A to 22E, which are defined on the nozzle-forming surface 21*a* of the recording head 21. A cap small chamber (not shown) is defined in each of the seal portions 52 and receives an ink absorbing member 53. The ink absorbing members 53 absorb and retain the ink ejected from the nozzle openings 22 of the corresponding nozzle rows 22A to 22E.

With reference to FIGS. 9A-C and 10, a projection 54 projects horizontally and outwardly from each of the left and right walls of the cap holders 51*a*. Each of the projections 54 is engaged with the guide bore 49 of the corresponding plate 48, which is formed integrally with the associated movable member 41. When the movable members 41 (and the plates 48) are moved in the front-and-back direction through rotation of the lead screws 31, 32, the projections 54 projecting from the cap holder 51*a* slide in the guide bores 49 of the plates 48. Particularly, the projections 54 move in the up-and-down direction when sliding along the diagonal portions 49*b* of the guide bores 49.

That is, the cap member 51 is located at a sealing position, or an uppermost position, when the projections 54 of the cap holder 51*a* are engaged with the front horizontal portions 49*c* of the guide bore 49 of the plates 48. In this state, the nozzle-forming surface 21*a* of the recording head 21 can be sealed through tight contact with the seal portions 52. Contrastingly, the cap member 51 is located at a non-sealing position, or a lowermost position spaced from the nozzle-forming surface 21*a* of the recording head 21, when the projections 54 of the cap holder 51*a* are engaged with the rear horizontal portions 49*a* of the guide bore 49 of the plates 48.

When the lead screws 31, 32 rotate and the movable members 41 move along the second threaded sending portions 34, 36, the projections 54 of the cap holder 51*a* are slidably guided by the diagonal portions 49*b* of the guide bores 49 of the plates 48, which move integrally with the movable members 41. This selectively raises and lowers the cap member 51 between the sealing position and the non-sealing position in association with the movement of the movable members 41.

As shown in FIGS. 4 and 5, ink drainage tubes 55, or liquid passages, extend from the front wall of the cap member 51. Each of the ink drainage tubes 55 corresponds to one of the cap small chambers in which the ink absorbing members 53 are received. Each ink drainage tube 55 is routed into the suction pump 29 that is supported by the attachment plate 27 at a position below the body 25. When the cap member 51 is located at the sealing position and the suction pump 29 is activated, the waste ink is drawn from the cap small chambers through the corresponding ink drainage tubes 55 and discharged into the waste ink tank (not shown) that is arranged in a lower portion of the space in the body casing 11.

With reference to FIGS. 3, 12, and 13, a pressing piece 56, which has a substantially triangular shape as viewed from above, projects horizontally from an outer side surface of the plate 48 that is located inward from the right frame member 25*c* of the body 25. The pressing piece 56 serves as an associating portion through which the movable member 41 associates with the valve body 66. The pressing piece 56 extends through a cutout groove 57, which is defined in the right frame member 25*c* and extends in the front-and-back direction, and projects to the exterior of the body 25. When the lead screws 31, 32 rotate and the movable members 41 and then the plates 48 move in the front-and-back direction, the pressing piece 56 moves in the front-and-back direction together with the movable members 41 and the plates 48 to operate an air exposure valve device 58 including a valve body 66.

Hereinafter, the air exposure valve device 58 including the valve body 66 will be explained.

As particularly shown in FIG. 3, the air exposure valve device 58 is arranged outside the rear end of the right frame member 25*c* of the body 25. The air exposure valve device 58 is located on the movement path of the pressing piece 56 projecting from the associated movable member 41, which has been described above. As shown in FIGS. 12A, 12B, 13A, and 13B, the air exposure valve device 58 has a rectangular box-like casing portion 59 fixed to the right frame member 25*c* of the body 25. A rectangular opening 61 is defined in a bottom wall 60 of the casing portion 59 to be sized to extend substantially a front half of the bottom wall 60.

Figure 13A:
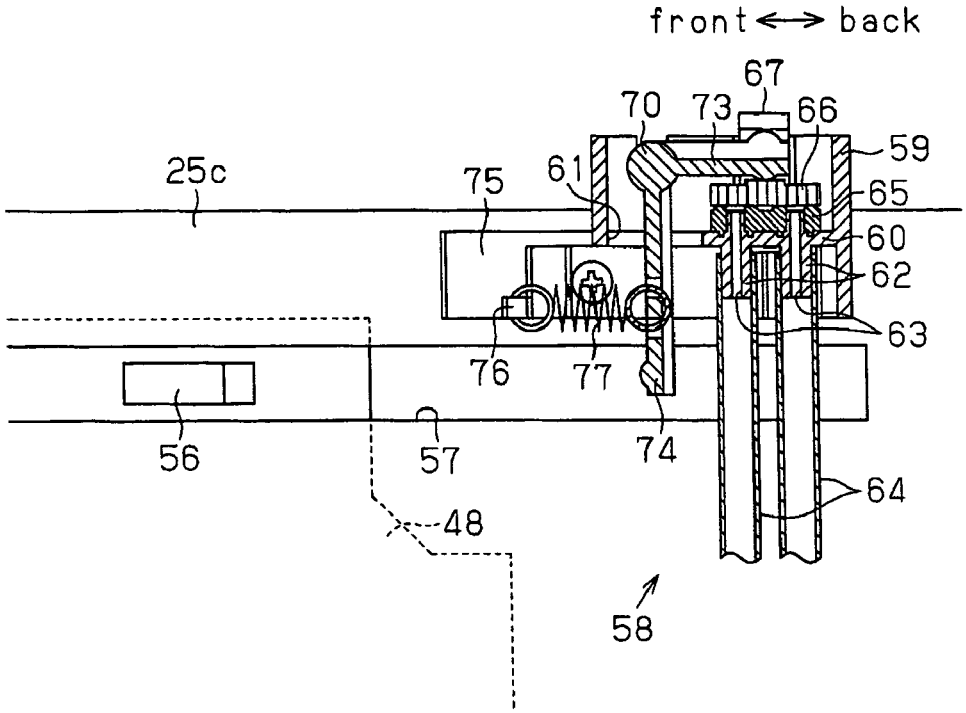
FIG. 13A is a cross-sectional view taken along line 13-13A of FIG. 12A.
Figure 13B:
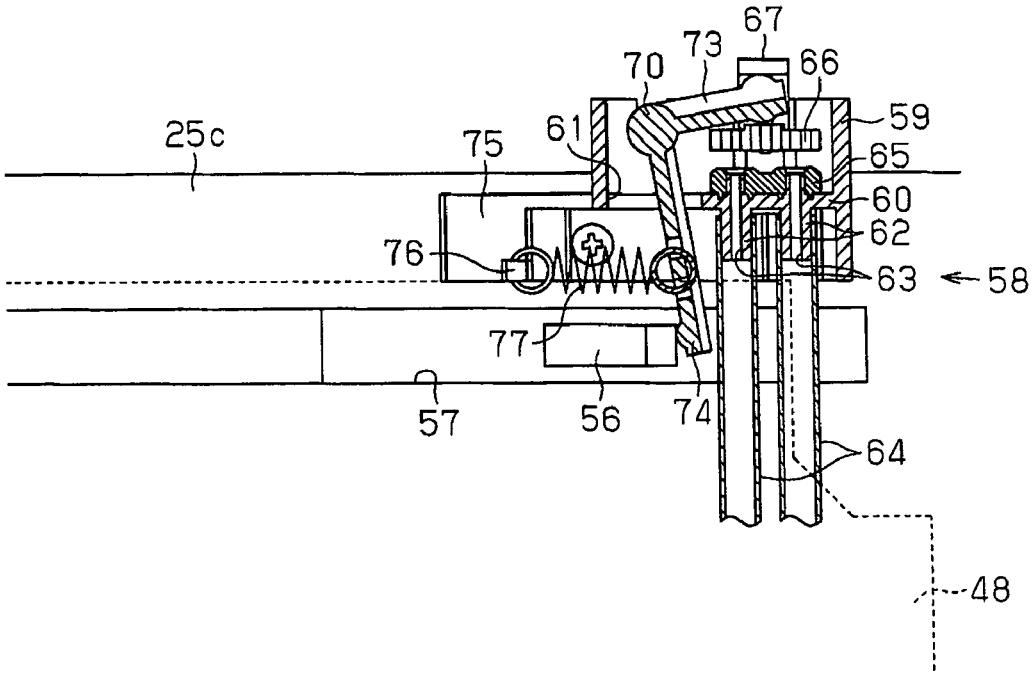
FIG. 13B is a cross-sectional view showing a state in which the pressing valve is retracted from the state of FIG. 13A.

Referring to FIGS. 13A and 13B, a plurality of (in the illustrated embodiment, five) cylindrical portions 62 are provided on the bottom wall 60 of the casing portion 59. One of the opposing ends of each of the cylindrical portions 62 projects upward and the other projects downward. Each cylindrical portion 62 defines a atmospheric or air exposure hole 63. The upper end of an air tube 64 is connected to the lower end of each cylindrical portion 62, which extends downward from a lower surface of the bottom wall 60. With reference to FIG. 5, the lower end of each air tube 64 is routed into the rear wall of the cap member 51 and communicates with the corresponding cap small chamber.

Figure 12A:
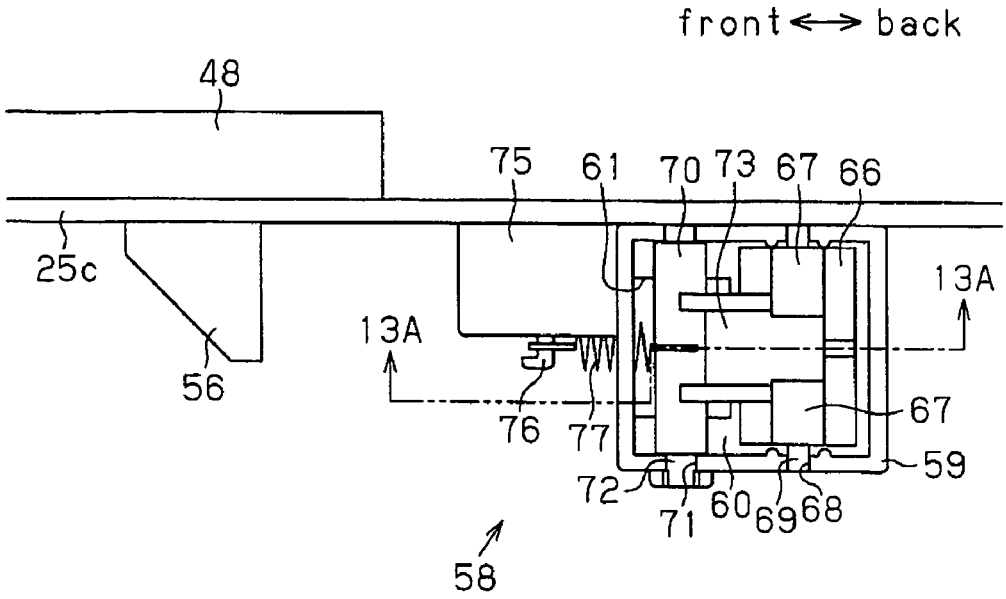
FIG. 12A is a plan view showing the relative positions of an air exposure valve device and a pressing valve.

A valve seat 65 formed of elastic material such as rubber is secured to the upper end of each cylindrical portion 62 that projects from an upper surface of the bottom wall 60 in such a manner as to ensure communication between the air exposure hole 63 and the air. As shown in FIGS. 12A, 13A, and 13B, a rectangular plate-like valve body 66, or a valve body 66, is mounted on each of the valve seats 65. A pair of hook-like engagement pieces 67 are provided on an upper surface of each valve body 66 and at opposing sides of the valve body 66, as opposed to each other in a symmetrical manner.

Figure 12B:
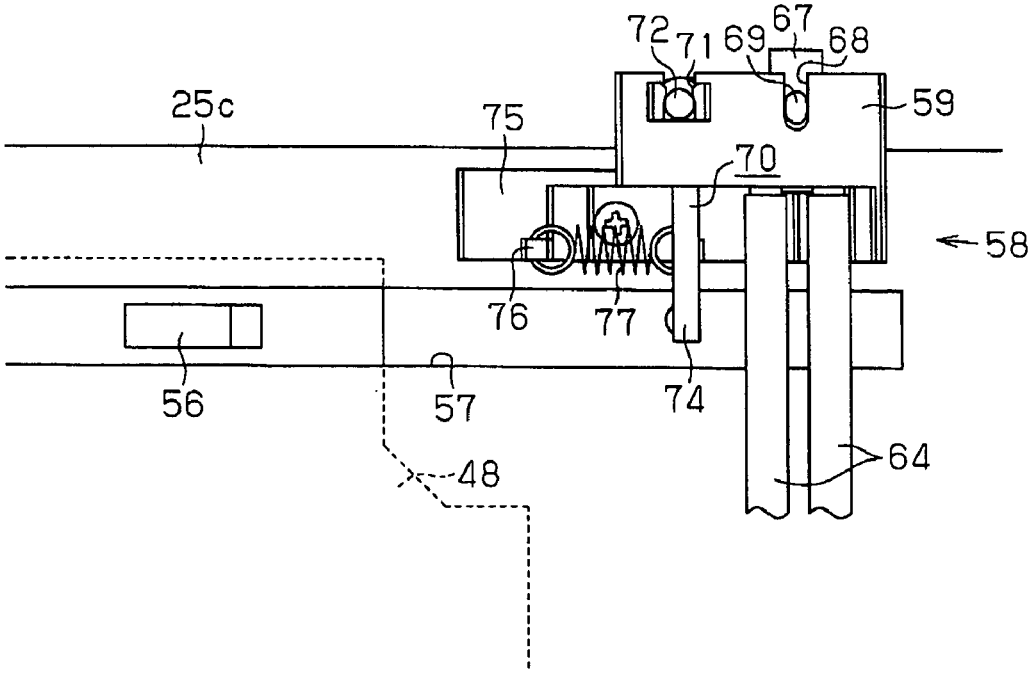
FIG. 12B is a front view corresponding to FIG. 12A.

As shown in FIGS. 12A and 12B, a projection 69 projects from an outer surface of each engagement piece 67 and is engaged with a cutout groove 68, which extends downward from the upper end of the casing portion 59. The projection 69 slides along the cutout groove 68 in the up-and-down direction. This moves the associated valve body 66 between an upper position, or an opening position, and a closing position (a lower position). When located at the opening position, the valve body 66 permits communication between the corresponding ink drainage tube 55, to which the valve body 66 is connected through the air tube 64 and the cap small chamber, and the air. When located at the closing position, the valve body 66 prohibits such communication.

A support groove 71 is defined at the upper end of the casing portion 59 at a position forward from the cutout groove 68 in the casing portion 59. The support groove 71 supports a lever member 70 that moves for selectively opening and closing the valve bodies 66. With reference to FIGS. 13A and 13B, the lever member 70 has an inverse L-shaped cross section. A projection 72 horizontally projects from each of the opposing right and left ends of the bent portion of the lever member 70 and is engaged with the support groove 71. In this manner, the lever member 70 is supported by the casing portion 59 of the air exposure valve device 58 in such a manner as to allow movement of the lever member 70.

A horizontal arm 73 extends backward from the bent portion of the lever member 70 while a suspended arm 74 extends vertically from the bent portion. Specifically, the horizontal arm 73 extends between the valve bodies 66 and the upper ends of the engagement pieces 67 and reaches the position behind the engagement pieces 67. The suspended arm 74 extends through the opening 61 defined in the bottom wall 60 of the casing portion 59 and reaches a lower position, or the position crossing the movement path of the pressing piece 56 of the movable member 41.

As shown in FIGS. 12A, 12B, 13A, and 13B, a seat 75 having a parallelepiped shape is secured to a portion of the right frame member 25*c* of the body 25 in the vicinity of the front side of the casing portion 59. A hook-like portion 76 projects from a side surface of the seat 75. A coil spring 77 is provided between the hook-like portion 76 and the suspended arm 74 of the lever member 70. Normally, referring to FIG. 13A, the urging force of the coil spring 77 maintains the lever member 70 in a state in which the suspended arm 74 extends vertically with the horizontal arm 73 slightly spaced downward from the engagement pieces 67 of the valve bodies 66 held at the closing positions.

Meanwhile, referring to FIG. 13B, if the pressing piece 56 retreats together with the movable members 41 and presses the suspended arm 74 against the urging force of the coil spring 77, the lever member 70 rotates about the projection 72. In this state, the horizontal arm 73 becomes engaged with the engagement pieces 67 to raise each valve body 66 from the closing position to the opening position. In this manner, the suspended arm 74 of the lever member 70 of the air exposure valve device 58 is selectively pressed by and released from the pressing piece 56 that moves integrally with the movable members 41. This selectively raises and lowers the valve bodies 66 between the lower closing positions and the upper opening positions in association with movement of the movable members 41. In the illustrated embodiment, the pressing piece 56 presses the suspended arm 74 of the lever member 70 of the air exposure valve device 58 when the movable members 41 retreat backward along the rear first threaded sending portions 33, 35 of the lead screws 31, 32.

The movable members 42 for moving the wiper 79 will be explained later.

As shown in FIGS. 3 to 6, a wiper holder 78 connects the two movable members 42. The wiper holder 78 serves as an associating member through which the movable member 42 associates with the wiper or the wiper 79. The wiper 79 is secured to an upper surface of the wiper holder 78 and extends along the entire longitudinal direction of the wiper holder 78 and in a slightly diagonal direction. When the lead screws 31, 32 rotate and the movable members 42 and the wiper holder 78 move in the front-and-back direction, the wiper 79 moves in the front-and-back direction in association with movement of the movable members 42 and the wiper holder 78.

The wiper 79 is an all-row wiper and moves in the front-and-back direction with its distal end or upper end slided on the nozzle-forming surface 21*a* of the recording head 21. In this manner, the wiper 79 wipes the entire nozzle-forming surface 21*a* throughout the nozzle rows 22A to 22E that are defined on the nozzle-forming surface 21*a*. Therefore, when the movable members 42 are moved along the second threaded sending portions 34, 36 through rotation of the lead screws 31, 32 with the carriage 16 and the recording head 21 maintained at the home position HP, the wiper 79 wipes the entire nozzle-forming surface 21*a* of the recording head 21.

The movable members 43 for moving a wiper 81 and a flushing box 88 will hereafter be explained.

Referring to FIGS. 3 to 6, a wiper holder 80 connects the two movable members 43. The wiper holder 80 serves as an associating member through which the movable member 43 associates with a wiper 81 and a flushing box 88. The wiper 81 is secured to an upper surface of the wiper holder 80 in the vicinity of the left end of the wiper holder 80 in the longitudinal direction of the wiper holder 80. When the lead screws 31, 32 rotate and the movable members 43 and the wiper holder 80 move in the front-and-back direction, the wiper 81 moves in the front-and-back direction in association with movement of the movable members 43 and the wiper holder 80.

The wiper 81 is a single-row wiper and moves in the front-and-back direction with the distal end or the upper end of the wiper 81 slided on the nozzle-forming surface 21*a* of the recording head 21. In this manner, the wiper 81 exclusively wipes an area including any one of the nozzle rows 22A to 22E defined on the nozzle-forming surface 21*a*, or a portion of the nozzle-forming surface 21*a*. Therefore, before operating the single-row wiper 81, the position of the carriage 16 and the position of the recording head 21 are adjusted at the home position HP in the left-and-right direction in such a manner that one of the nozzle rows, which is a target of wiping, is located in correspondence with the movement path of the wiper 81 in the front-and-back direction. Then, when the movable members 43 are moved along the second threaded sending portions 34, 36 through rotation of the lead screws 31, 32, the wiper 81 wipes the corresponding portion of the nozzle-forming surface 21*a* of the recording head 21.

As shown in FIGS. 5 and 9 to 11, a pair of support pieces 82 project forward from the front wall of the rear casing 25*a* of the body 25. A cutout groove 83 having a hook-like shape extends backward from the top of the distal end of each of the support pieces 82. A rectangular seal plate 84 or a lid body that has a front seal surface is arranged between the left and right support pieces 82. Shaft portions 85 project horizontally from the opposing left and right sides of the seal plate 84. Each of the shaft portions 85 is engaged with the cutout groove 83 of the corresponding one of the support pieces 82 in such a manner as to allow pivoting of the seal plate 84 about the shaft portions 85 or the pivotal center.

Coil springs 86 are provided between the front surface of the rear casing 25*a* and a rear surface of the seal plate 84 and above the support pieces 82. Normally, the urging force generated by the coil springs 86 or the urging members urges the seal plate 84 to pivot about the shaft portions 85 or the pivotal center in a clockwise direction of FIGS. 9A to 11B. A projection 87, which serves as a stopper, projects forward from the front surface of the rear casing 25*a* at a position lower than the support pieces 82. A lower portion of the rear surface of the seal plate 84 contacts the projection 87 when the seal plate 84 is urged to pivot by the coil springs 86. This prevents the seal plate 84 from further pivoting.

Figure 14:
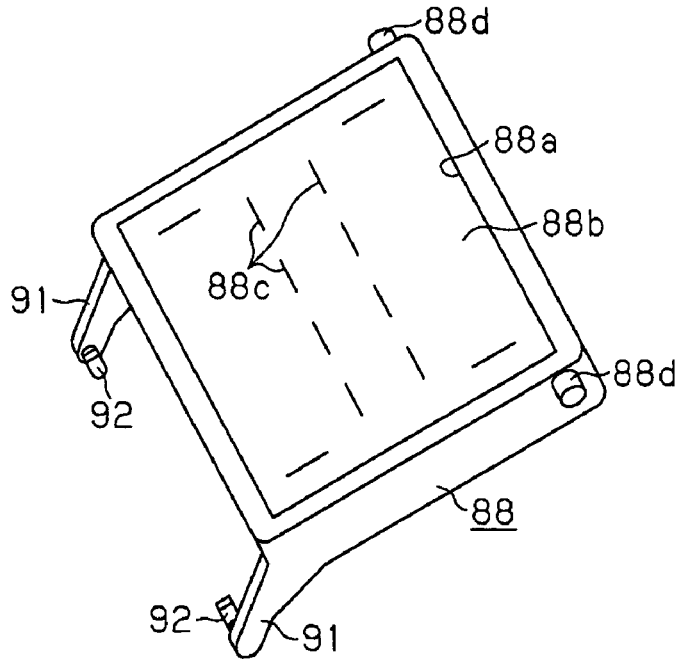
FIG. 14 is a perspective view showing the flushing box.

As shown in FIGS. 3, 5, and 9 to 11, a flushing box 88, which is a liquid receiver, is provided between the seal plate 84 and the wiper holder 80. As shown in FIG. 14, the flushing box 88 is a box having a closed bottom and has a rectangular opening 88*a* defined in correspondence with the nozzle-forming surface 21*a* of the recording head 21. A liquid absorbing material 88*b* is received in the flushing box 88 with a wire 88*c* stopping the liquid absorbing material 88*b* from falling from the flushing box 88. The liquid absorbing material 88*b* is formed of the same material as the ink absorbing materials 53 accommodated in the cap small chambers of the aforementioned cap member 51.

With reference to FIGS. 3 and 5, an end of a waste liquid tube 89, which forms a liquid drainage line, is connected to a substantial center of one side of the bottom of the flushing box 88 so that the waste liquid tube 89 communicates with the interior of the flushing box 88. The opposing end of the waste liquid tube 89 is routed into the suction pump 29 and then the waste ink tank (not shown), which is provided in the lower portion of the space in the body casing 11.

Referring to FIG. 14, a pair of pin portions 88*d* project horizontally at an end of the flushing box 88. The pin portions 88*d* are pivotally supported by the two support pieces 90 that project backward from the left and right ends of the aforementioned wiper holder 80. Through such arrangement, the flushing box 88 is supported by the wiper holder 80 pivotally about the pin portions 88*d*.

Figure 9A:
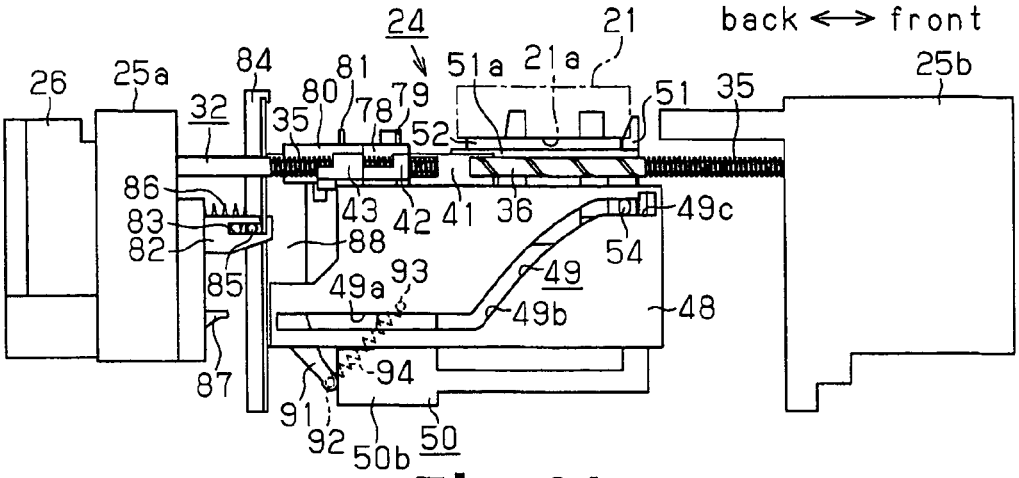
FIG. 9A is a view schematically showing the maintenance unit when a cap member is located at a sealing position.

As illustrated in FIGS. 3, 5, and 9A, when the flushing box 88 is not in operation, or not receiving the ink from the recording head 21, the flushing box 88 is held at a non-receiving position with its opening 88*a* arranged backward and extending substantially vertical. The opening 88*a* is thus blocked by the front surface of the seal plate 84. This prevents dryness and solidification of the ink retained by the liquid absorbing material 88*b* in the flushing box 88.

Referring to FIG. 14, a pair of plate-like leg portions 91 are formed integrally with the opposing end of the flushing box 88. The leg portions 91 project diagonally outward from the bottom surface of the flushing box 88. Pin portions 92 project horizontally from the inner sides of the distal ends of the leg portions 91. The aforementioned holder member 50 has a pair of plate-like support pillar portions 50*a* that project from the left and right sides of the rear end of the holder member 50. The leg portions 91 are arranged in correspondence with base portions 50*b* of the support pillar portions 50*a* in the left-and-right direction. As illustrated in FIG. 9A, when the flushing box 88 is not in operation and held in a substantially vertical state, the leg portions 91 contact the base portions 50*b* from behind.

A pair of pin portions 93 project horizontally from the inner sides of a substantial middle portion of the holder member 50 in the direction defined by the height of the left and right support pillar portions 50*a*. The pin portions 93 are arranged in correspondence with the pin portions 92 of the leg portions 91 of the flushing box 88. A coil spring 94 is arranged between each of the pin portions 92 and the corresponding one of the pin portions 93. Typically, the urging force of the coil springs 94 urges the flushing box 88 to pivot about the pivotal center defined by one end of the flushing box 88, or the pin portions 88*d* formed at the upper end of the flushing box 88, in the direction (a counterclockwise direction of FIGS. 9A to 11B) in which the leg portions 91 are pressed against the base portions 50*b* of the support pillar portions 50*a* of the holder member 50.

Referring to FIGS. 9A to 11B, a width increasing stepped portion 95 is provided in an inner side of each support pillar portion 50*a* of the holder member 50 at a position downward from the upper end of the support pillar portion 50*a* by the distance corresponding to the depth of the flushing box 88. The width increasing stepped portion 95 is a portion that induces change of the posture of the flushing box 88. This structure allows the flushing box 88 to pass between the left and right support pillar portions 50*a* of the holder member 50 at a position higher than the width increasing stepped portion 95. The flushing box 88 is thus allowed to move in the front-and-back direction.

Therefore, when the movable members 43 and the wiper holder 80 move in the front-and-back direction through rotation of the lead screws 31, 32, the flushing box 88 moves in the front-and-back direction in association with movement of the movable members 43 and the wiper holder 80. That is, when the lead screws 31, 32 rotate and the movable members 43 move along the second threaded sending portions 34, 36, the flushing box 88 is moved through cooperative movement of the two pin portions 88*d*, which are supported by the movable members 43 through the support pieces 90 of the wiper holder 80. Further, through such movement of the pin portions 88*d*, the flushing box 88 is moved in the front-and-rear direction and between a receiving position (see FIG. 11B) and a non-receiving position (see FIG. 9A) spaced from the receiving position. When located at the receiving position, the flushing box 88 is held in a horizontal posture with the opening 88*a* opposed closely to the nozzle surface 21*a* of the recording head 21.

Figure 11A:
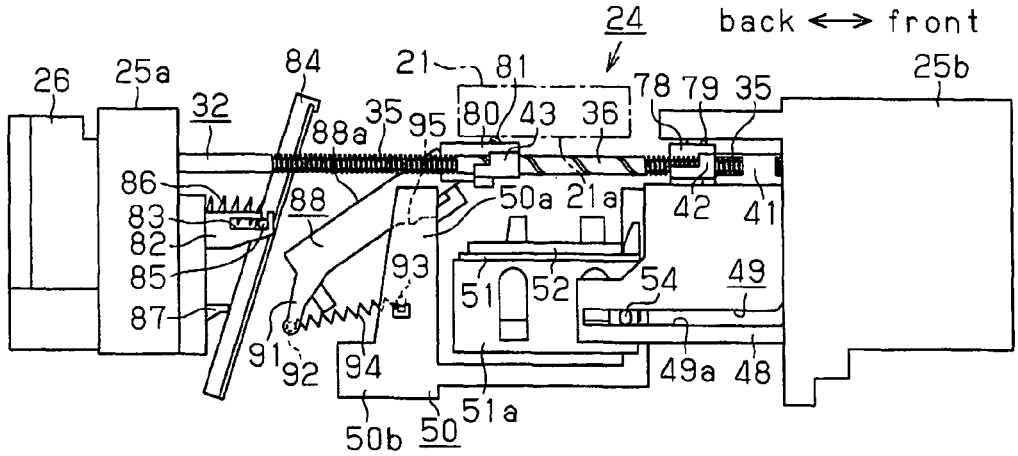
FIG. 11A is a view schematically showing a main portion of the maintenance unit when a single-row wiper is located at a wiping position.
Figure 11B:
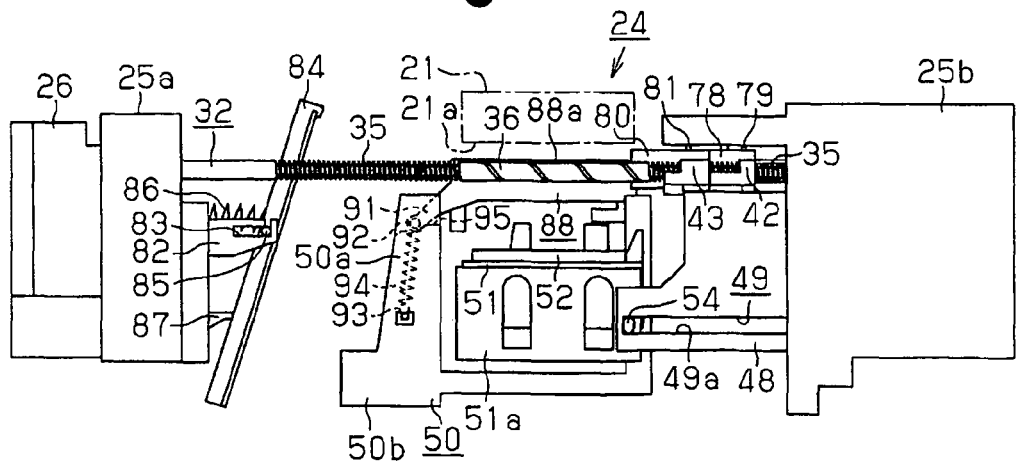
FIG. 11B is a view schematically showing a flushing box located at a liquid receiving position.

Specifically, when the movable members 43 move forward, the flushing box 88 receives the urging force of the coil spring 94. The coil spring 94 thus urges the flushing box 88 to pivot about the pin portions 88*d*, or the pivotal support points, in a direction in which the flushing box 88 is switched to a vertical posture. In this process, the posture of the flushing box 88 first becomes inclined, as illustrated in FIG. 11A, with the bottom surface of the flushing box 88 held in contact with the width increasing stepped portions 95. The flushing box 88 then continuously moves forward together with the movable members 43 in the direction in which the inclined posture of the flushing box 88 gradually becomes horizontal. After the movable members 43 move further forward, the leg portions 91 of the flushing box 88 are brought into contact with the width increasing stepped portions 95. Eventually, as illustrated in FIG. 11B, the flushing box 88 is held in the horizontal posture with the distal ends of the leg portions 91 held in contact with the width increasing stepped portions 95.

That is, in forward movement of the movable members 43, the flushing box 88 is stably switched from the vertical posture to the horizontal posture through contact between the bottom surface or the leg portions 91 of the flushing box 88 and the width increasing stepped portions 95. The flushing box 88 is stably maintained in the horizontal posture at the receiving position with the distal ends of the leg portions 91 held in contact with the width increasing stepped portions 95 by the urging force of the coil spring 94.

Contrastingly, reverse movement of the movable members 43 switches the flushing box 88 from the receiving position to the non-receiving position. Also in this case, the flushing box 88 receives the urging force of the coil spring 94, as in the case of the forward movement of the movable members 43. The flushing box 88 thus stably switches from the horizontal posture to the vertical posture via the inclined posture, in which the bottom surface and the leg-portions 91 of the flushing box 88 are held in contact with the width increasing stepped portions 95. As illustrated in FIG. 9A, when held in the vertical posture at the non-receiving position, the flushing box 88 is stably maintained in the vertical posture by the urging force that is applied by the coil spring 86 through the seal plate 84 and that acts in the opposite direction to the acting direction of the urging force of the coil spring 94, in addition to the urging force of the coil spring 94.

Next, operation of the printer 10, which is configured as above-described, will be explained. The explanation focuses on, particularly, operation of the maintenance unit 24.

In the maintenance unit 24 of the illustrated embodiment, the plurality of driven members such as the cap member 51, the valve bodies 66, the wipers 79, 81, and the flushing box 88, or a liquid receiver, operate in different operational areas for different operational purposes. In the following, operation for maintenance of each of these driven members will be described in turn.

First, operation of the cap member 51 will be explained.

Figure 9B:
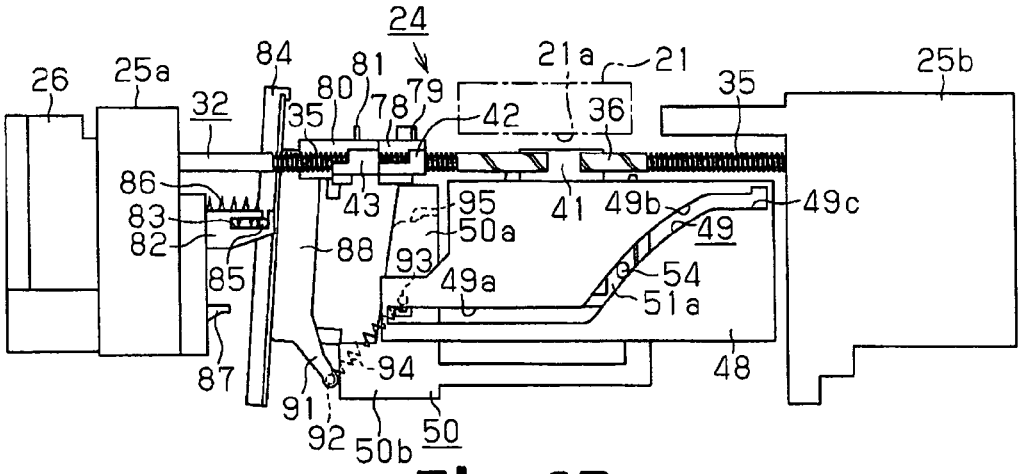
FIG. 9B is a view schematically showing the maintenance unit when the cap member is being raised or lowered.
Figure 9C:
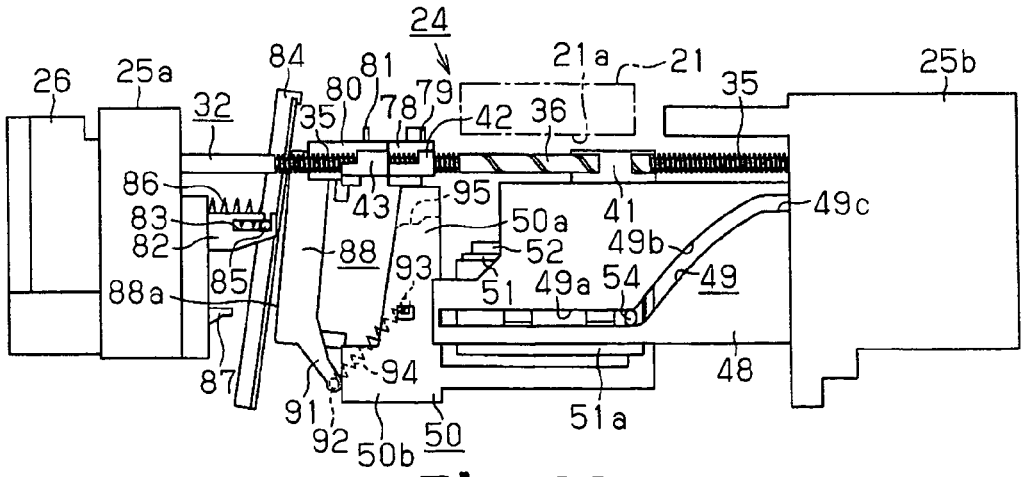
FIG. 9C is a view schematically showing the maintenance unit when the cap member is held at a non-sealing position.

In printing on the paper sheet P by the printer 10, as illustrated in FIG. 9C, the maintenance unit 24 may carry out cleaning, or draw and remove the ink from the nozzle openings 22 of the recording head 21 for the purpose of, for example, prevention of nozzle clogging. In that case, the printer 10 and the maintenance unit 24 operate in the following manners.

In printing, the carriage 16 reciprocates along the guide shaft 15 in a printing area. The carriage 16 is then returned from the position indicated by the double-dotted chain lines of FIG. 5 to the home position HP above the cap member 51 and then stopped. FIG. 5 corresponds to the state of the maintenance unit 24 of FIG. 9A. Afterwards, the drive motor 30 is driven to run in the reverse direction, thus rotating the lead screws 31, 32 in the reverse directions. This causes the movable members 41 to 43 to start retreating.

At this stage, or at the point of time corresponding to the state of FIG. 9C, the movable members 42, 43, the cylindrical portions 44 of which are engaged with the first threaded sending portions 33, 35 of the lead screws 31, 32, retreat relatively slowly. Contrastingly, the movable members 41, the cylindrical portions 44 of which are engaged with the second threaded sending portions 34, 36 of the lead screws 31, 32, retreat relatively quickly. In this state, the plates 48 that are formed integrally with the movable members 41 also retreat relatively rapidly.

Therefore, as illustrated in FIG. 9B, the projections 54 of the cap holder 51*a*, which are engaged with the guide bores 49 of the plates 48, are guided along the diagonal portions 49*b* of the guide bores 49 and thus rise rapidly. As a result, as illustrated in FIG. 9A, the cap member 51 is sent to the uppermost position, or the sealing position. At this position, the cap member 51 seals the nozzle-forming surface 21*a* of the recording head 21 located at the home position HP through sealing performance of the seal portions 52.

The suction pump 29 is then activated by driving the pump motor 28, causing negative pressure in the cap small chambers of the cap member 51 and the ink drainage tubes 55. The ink is thus drawn from the nozzle openings 22 of the recording head 21 and then discharged into the waste ink tank that is arranged downstream from the suction pump 29, in a pressurized state.

As has been described, when the maintenance unit 24 performs cleaning, which is a type of maintenance operation, the lead screws 31, 32 are rotated by the drive force produced by the drive motor 30. The associated ones of the movable members 41, 42 and 43 thus move commonly along the axes S of the corresponding lead screws 31, 32. In this state, the movable members 41 moving along the second threaded sending portions 34, 36 selectively raise and lower the cap member 51, which associates with the movable members 41 through the guide bores 49 and the projections 54, in association with movement of the movable members 41.

In this regard, the cap member 51 is a driven member driven by the movable members 41 and associates with the movable members 41 while allowing transmission of the drive force from the lead screws 31, 32. When sending the cap member 51 from the sealing position (corresponding to the state of FIG. 9A) to the non-sealing position (corresponding to the state of FIG. 9C), the drive motor 30 is driven to run in the forward direction in the state of FIG. 9A. This rotates the lead screws 31, 32 in the forward directions, thus causing the movable members 41 and the plates 48 to proceed. The projections 54 of the cap holder 51*a* are thus guided to move downward by the diagonal portions 49*b* of the guide bores 49. As a result, the cap member 51 is returned to the non-sealing position illustrated in FIG. 9C.

Next, operation of the air exposure valve device 58 including the valve body 66 will be described.

As has been described, to perform cleaning with the nozzle-forming surface 21*a* of the recording head 21 sealed by the cap member 51, the pressure in each cap small chambers of the cap member 51 and the pressure in each ink drainage tube 55 are forcibly lowered to a negative level. It is thus necessary to release the negative pressure from the cap small chambers and the ink drainage tubes 55 after cleaning is completed. For this purpose, the maintenance unit 24 operates in the following manner.

With the cap member 51 maintained at the sealing position (in the state of FIG. 9A) for sealing the nozzle-forming surface 21*a* of the recording head 21, the drive motor 30 is further rotated in the reverse direction, thus further rotating the lead screws 31, 32 in the reverse directions. This causes the movable members 41 to 43 to start further retreating.

When the maintenance unit 24 is held in the state of FIG. 9B, the pressing piece 56 is located at the position of FIG. 12, or at the right side of the maintenance unit 24. As the lead screws 31, 32 are rotated in the reverse directions further from this state, the movable members 41 to 43 are further retreated to the state of FIG. 9A. In this state, the pressing piece 56 is arranged immediately below the seat 75 of the air exposure valve device 58. Therefore, as the lead screws 31, 32 rotate in the reverse directions continuously from this state and the movable members 41 and the plates 48 further retreat, the pressing piece 56 that projects from the associated plate 48 also retreats continuously. Specifically, the plates 48 retreat continuously from the state of FIG. 9A to the state in which the projections 54 of the cap holder 51*a* are located in the vicinity of the front end of the front horizontal portions 49*c* of the guide bores 49. At this point, the pressing piece 56 contacts the suspended arm 74 of the lever member 70 of the air exposure valve device 58.

The lead screws 31, 32 rotate in the reverse directions further from this state and thus the plates 48 retreat continuously. This causes the pressing piece 56 to press the suspended arm 74 against the urging force of the coil spring 77, as illustrated in FIG. 13B, thus pivoting the suspended arm 74 in a counterclockwise direction. The horizontal arm 73 of the lever member 70 thus raises the valve bodies 66 through the engagement pieces 67 in such a manner that each of the valve bodies 66 separates from the valve seat 65 and rises to an air exposure position. This permits communication between the air exposure hole 63 and the air tube 64 and the air, thus releasing the negative pressure from each of the cap small chambers of the cap chamber 51 and each of the ink drainage tubes 55 through the air exposure hole 63 and the air tube 64.

As has been described, when the maintenance unit 24 performs air exposure operation which is a type of maintenance operation, the lead screws 31, 32 are rotated by the drive force produced by the drive motor 30, as in the case of cleaning. The associated ones of the movable members 41, 42 and 43 thus move commonly along the axes S of the corresponding lead screws 31, 32. In this state, the movable members 41, one of which is formed integrally with the plate 48 from which the pressing piece 56 projects, retreat relatively slowly along the front first threaded sending portions 33, 35. In such retreat, the movable members 41 raise the valve bodies 66 of the air exposure valve device 58.

In this regard, in addition to the aforementioned cap member 51, the valve bodies 66 of the air exposure valve device 58 are also driven members driven by the movable members 41 and associate with the movable members 41 while allowing transmission of the drive force from the lead screws 31, 32. To move the valve bodies 66 from the opening positions (corresponding to the state of FIG. 13B) to the closing positions (corresponding to the state of FIG. 13A), the drive motor 30 is driven to run in the forward direction in the state of FIG. 13B. This rotates the lead screws 31, 32 in the forward directions and causes the movable members 41 and the plates 48 to proceed. The pressing piece 56 is then separated from the suspended arm 74 of the lever member 70.

As a result, the lever member 70 restores the state of FIG. 13A by the urging force of the coil spring 77. The horizontal arm 73 of the lever member 70 is thus spaced downward from the engagement pieces 67 of the valve bodies 66, returning the valve bodies 66 to the closing positions at which the valve bodies 66 are seated on the valve seats 65.

Third, operation of the wipers 79, 81 will hereafter be explained.

In printing, the ink may adhere to the nozzle-forming surface 21*a* undesirably by, for example, being splashed back by the paper sheet P after drops of the ink have been ejected from the nozzle openings 22 onto the paper sheet P. Such adhesion of the ink may influence the direction in which the ink is ejected, leading to a printing problem. Thus, the ink must be wiped off or removed from the nozzle-forming surface 21*a*. For this purpose, the maintenance unit 24 operates in the following manner.

Specifically, with the maintenance unit 24 held in the state of FIG. 9C, the carriage 16 is moved from the position indicated by the double-dotted chain lines of FIG. 5 to the home position HP above the cap member 51 and then stopped. Subsequently, the drive motor 30 is driven to run in the forward direction, thus rotating the lead screws 31, 32 in the forward directions. This causes the movable members 41 to 43 to start proceeding.

At this stage, or at the point of time corresponding to the state of FIG. 9C, the movable members 41, the cylindrical portions 44 of which are engaged with the second threaded sending portions 34, 36 of the lead screws 31, 32, reach the front first threaded sending portions 33, 35 through continuous rotation of the lead screws 31, 32 in the forward directions and proceed along the first threaded sending portions 33, 35 relatively slowly. Meanwhile, the cylindrical portions 44 of the movable members 42, 43 are engaged with the rear first threaded sending portions 33, 35 of the lead screws 31, 32. The movable members 42, which are located forward from the movable members 43, reach the second threaded sending portions 34, 36 through continuous rotation of the lead screws 31, 32 in the forward directions and proceed along the second threaded sending portions 34, 35 relatively rapidly. In this state, the wiper holder 78, which connects the two movable members 42, also proceeds relatively rapidly.

Figure 10:
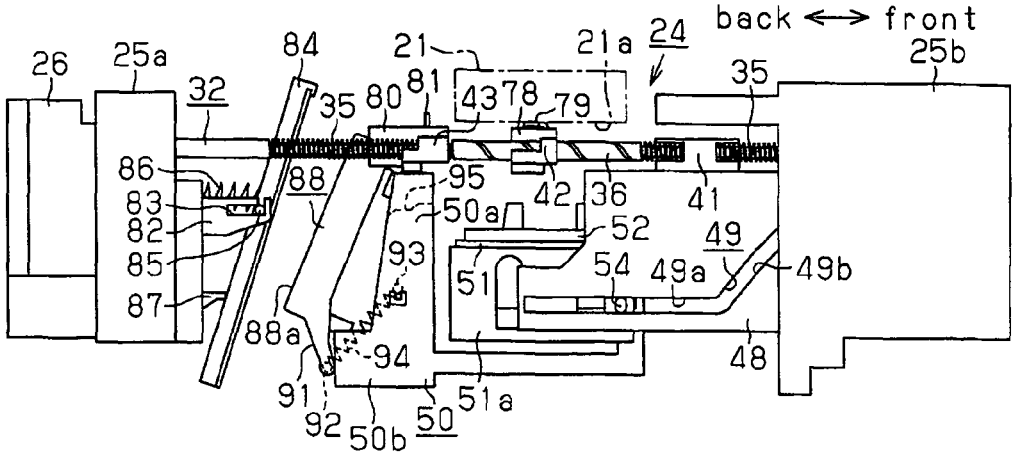
FIG. 10 is a view schematically showing the maintenance unit when an all-row wiper is located at a wiping position.

This advances the wiper 79, which is mounted on the upper surface of the wiper holder 78, from the non-wiping position of FIG. 9C to the wiping position of FIG. 10, together with the wiper holder 78. In proceeding, the wiper 79 slidably contacts the nozzle-forming surface 21*a* of the recording head 21 held at the home position HP while elastically deforming its distal end or the upper end. Through such slidable contact with the nozzle-forming surface 21*a*, the wiper 79 wipes off and removed the adhered ink from the nozzle-forming surface 21*a* throughout the entire nozzle-forming surface 21*a*.

The movement speed of each of the movable members 42 while engaged with the second threaded portions 34, 36 is varied to the speed suitable for wiping the ink on the nozzle-forming surface 21*a* of the recording head 21. Specifically, rotation speed of the lead screws 31, 32 is determined depending on the number of the pitches of each second threaded sending portions 34, 36. By rotating the lead screws 31, 32 at such speed, the cap member 51 is moved up and down between the sealing position and the non-sealing position as described above. When the movement speed of the cap member 51 is fast, the cap member 51 makes an impact on the recording head 21 when the cap member 51 moves upward to contact with the nozzle forming surface 21*a*. Accordingly, it is preferred that the inclination of the diagonal portions 49*b* is determined so that the cap member 51 moves slowly enough to prevent such impact from being made.

As has been described, when the maintenance unit 24 performs wiping which is a type of maintenance operation, the lead screws 31, 32 are rotated by the drive force produced by the drive motor 30, as in the cases of cleaning and air exposure. The associated ones of the movable members 41, 42 and 43 thus move commonly along the axes S of the corresponding lead screws 31, 32. In this state, the movable members 42 moving along the second threaded sending portions 34, 36 selectively advance or retract the wiper 79, which associates with the movable members 42 through the wiper holder 78, in association of the movable members 42.

In this regard, the wiper 79 is a driven member driven by the movable members 42 and associates with the movable members 42 while allowing transmission of the drive force from the lead screws 31, 32. After the wiper 79 has been sent from the non-wiping position (corresponding to the state of FIG. 9C) to the wiping position (corresponding to the state of FIG. 10), the nozzle-forming surface 21*a* is wiped. After such wiping, the drive motor 30 is rotated in the reverse direction to return the wiper 79 to the original position, or the non-wiping position. This causes reverse rotation of the lead screws 31, 32 and thus retreating of the movable members 42 and the wiper holder 78. As a result, the wiper 79 is returned to the original position, or the non-wiping position illustrated in FIG. 9C, together with the movable members 42 and the wiper holder 78. In such retreat, to prevent unnecessary wiping of the wiping surface 21*a* of the recording head 21 by the wiper 79, the recording head 21, together with the carriage 16, may be moved outside the home position HP.

Depending on, for example, the frequency of ink ejection, the zones defining the nozzle rows may be cleaned one by one instead of wiping off the adhered ink from the entire nozzle-forming surface 21*a*. In this case, the single-row wiper 81, which associates with the movable members 43 through the wiper holder 80, is operated instead of the all-row wiper 79.

Specifically, the lead screws 31, 32 are caused to rotate in the forward directions before the carriage 16 is sent to the home position HP. Further, the all-row wiper 79 is moved from the position of FIG. 9C to the position of FIG. 11A via the position of FIG. 10.

At this stage, the carriage 16 is returned to and stopped at the home position HP. At this stage, the position of the carriage 16 is adjusted in such a manner that one of the nozzle row defining zones, which is the target of wiping, is located in correspondence with the movement path of the wiper 81 in the front-and-back direction. Afterwards, the lead screws 31, 32 are rotated again in the forward directions. This causes the movable members 43 and the wiper holder 80 to retreat from the positions of FIG. 11 passing below the nozzle-forming surface 21*a* of the recording head 21 held at the home position HP. In this manner, the single-row wiper 81 wipes solely a portion of the nozzle-forming surface 21*a*.

As has been described, when the maintenance unit 24 performs wiping, which is a type of maintenance operation, the all-row wiper 79 and the single-row wiper 81 are selectively operated depending on whether the wiping should be carried out on the entire portion or a restricted portion of the nozzle-forming surface 21*a*. In either case, the lead screws 31, 32 are actuated by the drive force of the drive motor 30, as in the cases of the cleaning and the air exposure operation. Specifically, the associated ones of the movable members 41, 42 and 43 move along the axes S of the corresponding lead screws 31, 32. To wipe the restricted portion of the nozzle-forming surface 21*a*, the movable members 43 moving along the second threaded sending portions 34, 36 selectively advance and retract the wiper 81, which associates with the movable members 43 through the wiper holder 80, in association with movement of the movable members 43.

In this regard, the wiper 81 is a driven member driven by the movable members 43 and associates with the movable members 43 while allowing transmission of the drive force from the lead screws 31, 32. After the recording head 21 is moved from the home position HP to prevent the wiper 81 from contacting the nozzle surface 21*a* of the recording head 21, the drive motor 30 is rotated in the reverse direction. This causes reverse rotation of the lead screws 31, 32 and thus retreating of the movable members 43 and the wiper holder 80. As a result, the wiper 81 is returned to the original position, or the non-sealing position illustrated in FIG. 9C, together with the movable members 43 and the wiper holder 80. Afterwards, the recording head 21 is returned to the home position HP in such a manner that a different zone of the nozzle surface 21*a* other than the portion of the nozzle surface 21*a* that has been wiped is located on the movement path of the wiper member 81. The movable members 43 are then moved forward to allow wiping of the different portion of the nozzle surface 21*a*.

Finally, operation of the flushing box 88 will be described as follows.

After completion of wiping of the nozzle surface 21*a* of the recording head 21 by the wiper member 81 as illustrated in FIG. 11B, flushing is performed to stabilize the meniscus of the ink in each of the nozzle openings 22. As used herein, the term "flushing" refers to ejection of the ink from the nozzle openings 22 through excitement of piezoelectric elements (not shown), which are arranged in the recording head 21 in correspondence with the nozzle openings 22 and which are excited in response to a control signal unrelated to printing. Specifically, the flushing box 88 is moved forward in association with the movable members 43 that move forward, while changing the posture of the flushing box 88 from the position of FIG. 9C to the position of FIG. 11B.

While switching from the state of FIG. 9C to the state of FIG. 11B, the position of the flushing box 88 changes in the following manner. Before the movable members 43 start proceeding, the flushing box 88 is held in a substantially vertical state, as illustrated in FIG. 9C. As the lead screws 31, 32 rotate in the forward directions, the movable members 43 gradually advance along the rear first threaded sending portions 33, 35. In such advancing of the movable members 43, the flushing box 88 pivots about the pin portions 88*d*, which are located at one end, or the upper end, of the flushing box 88, in a clockwise direction of FIGS. 9A to 10. In other words, the flushing box 88 changes its position while moving in the front-and-back direction that is perpendicular to the reciprocating direction of the carriage 16, or the left-and-right direction.

More specifically, at a first stage, the legs 91 are held in contact with the base portions 50*b* of the support pillar portions 50*a* of the holder member 50 by the urging force of the coil spring 94. However, as the movable members 43 continuously proceed from the positions of FIG. 10, the bottom surface of the flushing box 88 is mounted on the width increasing stepped portions 95 of the support pillar portions 50*a*. Then the lead screws 31, 32 are further rotated in a forward direction in such a manner that the movable members 43 reach the second threaded sending portions 34, 36, as illustrated in FIG. 11B.

From this point of time, the movable members 43 advances at increased speed to the front first threaded sending portions 33, 35. In this state, the flushing box 88 is deployed at the receiving position that is immediately below the home position HP while maintaining a horizontal position with the leg portions 91 supported by the width increasing stepped portion 95 of the support pillar portions 50*a*. At this stage, the carriage 16 is sent to and stopped at the home position HP that is immediately above the flushing box 88. The opening 88*a* of the flushing box 88 thus becomes opposed and close to the nozzle-forming surface 21*a* of the recording head 21. Then, the ink is ejected from the nozzle openings 22 of the recording head 21 for the flushing. The ink is thus absorbed and retained by the liquid absorbing material 88*b* in the flushing box 88.

As has been described, immediately after completion of wiping of the nozzle surface 21*a* by the wiper member 81, the flushing box 88 is moved to the receiving position at which the flushing box 88 is held in the horizontal posture. In this state, the ink is ejected from the nozzle openings 22 of the recording head 21, thus performing flushing. Afterwards, if an instruction for printing has been already provided, the recording head 21, together with the carriage 16, is moved to the printing area and printing is performed on the paper sheet P.

Meanwhile, there are cases in which the maintenance unit 24 performs flushing using the flushing box 88 with the nozzle surface 21*a* of the recording head 21 sealed by the cap member 51, as illustrated in FIG. 9A, before printing is started on the paper sheet P. Such flushing is carried out, for example, after the printer 10 has not been operated, or has been maintained in a turned-off state, for several days, with the ink dried in the nozzle openings 22 and the viscosity of the ink increased. To perform such pre-printing flushing, the printer 10 and the maintenance unit 24 are operated in the following manners.

First, the carriage motor 19 is actuated in the state of FIG. 9A, moving the recording head 21 integrally with the carriage 16 to positions outside the home position HP. The drive motor 30 is then rotated in the forward direction to rotate the lead screws 31, 32 in the forward directions. This moves the cap member 51 and the wiper member 79 to the positions of FIG. 11A in association of proceeding of the corresponding movable members 41, 42. The drive motor 30 is then continuously rotated in the forward direction from this state, thus continuously rotating the lead screws 31, 32 in the forward directions.

Then, through continuous rotation of the lead screws 31, 32 in the forward directions, the movable members 43 and the wiper holder 80 proceed from the state of FIG. 11A, passing below the home position HP. The movable members 43 then reach the front first threaded sending portions 33, 35, as illustrated in FIG. 11B. In this case, the single-row wiper 81, which is secured to the upper surface of the wiper holder 80, also proceeds passing below the home position HP, integrally with the movable members 43. However, since the carriage 16 is not yet deployed at the home position HP at this stage, unnecessary wiping of the nozzle-forming surface 21*a* does not occur.

At this stage, as has been described, the flushing box 88 is held at the receiving position immediately below the home position HP while maintained in the horizontal posture with the leg portions 91 of the flushing box 88 supported by the width increasing stepped portions 95 of the support pillar portions 50*a*. In this state, the carriage 16 is moved to and stopped at the position immediately above the flushing box 88 held at the home position HP. The opening 88*a* of the flushing box 88 is thus opposed closely to the nozzle surface 21*a* of the recording head 21. Then, the ink is ejected from the nozzle openings 22 of the recording head 21 for the flushing. The ink is thus absorbed and retained by the liquid absorbing material 88*b* in the flushing box 88.

As has been described, when the maintenance unit 24 performs flushing, which is a type of maintenance operation, by the maintenance unit 24, the lead screws 31, 32 are actuated by the drive force of the drive motor 30, as in the cases of the cleaning, the air exposure, and the wiping. The associated ones of the movable members 41, 42 and 43 thus move along the axes S of the corresponding lead screws 31, 32. The movable members 43 advance or retract the flushing box 88 or change the position of the flushing box 88, which associates with the movable members 43 through the wiper holder 80, in association with movement of the movable members 43.

In this regard, in addition to the above-described wiper 81, the flushing box 88 is a driven member driven by the movable members 43 and associates with the movable members 43 while allowing transmission of the drive force from the lead screws 31, 32. To return the flushing box 88 from the receiving position (corresponding to the state of FIG. 11B) to the non-receiving position (corresponding to the state of FIGS. 9A to 9C) after the flushing, the drive motor 30 is rotated in the reverse direction in the state of FIG. 11B. This causes reverse rotation of the lead screws 31, 32 and thus retreat of the movable members 43 and the wiper holder 80. The urging force of the coil springs 94 thus urge the flushing box 88 to pivot in the direction in which the leg portions 91 are brought into contact with the base portions 50*b* of the support pillar portions 50*a*. As a result, the flushing box 88 is returned to the non-receiving position as illustrated in FIG. 9C.

Before the printer 10 is turned off, the lead screws 31, 32 are further rotated in the reverse directions in such a manner that the movable members 43 retreat to the positions of FIG. 9A. This causes the flushing box 88 to pivot about the pin portions 88*d* and restore a vertical position. The opening 88*a* of the flushing box 88 is thus blocked by the seal plate 84. In this state, the coil springs 86 urge the seal plate 84 toward the flushing box 88, ensuring sealing performance of the opening 88*a* of the flushing box 88.

Figure 15:
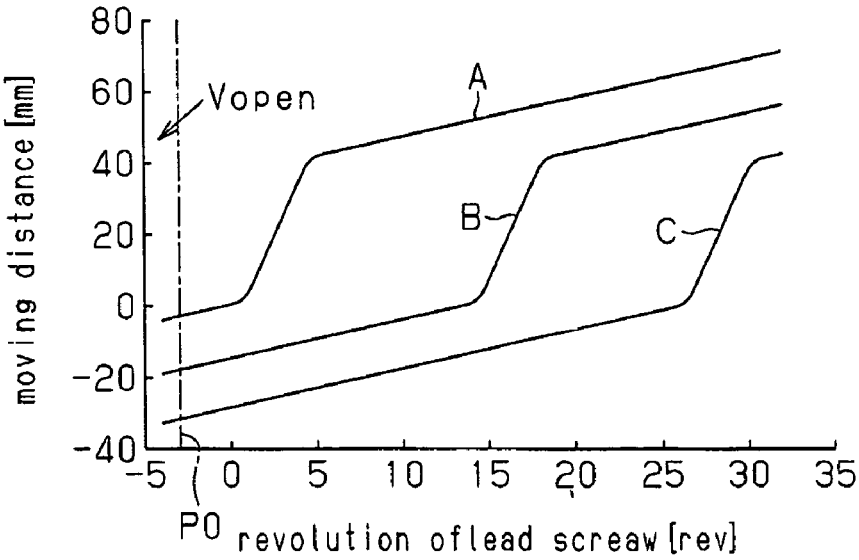
FIG. 15 is a graph representing the relationship between the rotation amount of the lead screw and the movement distances of the movable members.

FIG. 15 is a graph representing variation of the movement distance of the movable members 41 to 43 in correspondence with the rotational amount (rev) of the lead screws 31, 32. In the graph, the solid line A represents the movement distance of each movable member 41. The solid line B represents the movement distance of each movable member 42. The solid line C represents the movement distance of each movable member 43. As is understood from FIG. 15, although the associated ones of the movable members 41, 42 and 43 are mounted on the same lead screws 31, 32 and move along the direction of the axes S of the lead screws 31, 32, the movable members 41 to 43 are moved to different positions in the direction of the axes S of the lead screws 31, 32 in correspondence with the rotation amount of the lead screws 31, 32.

The solid lines A, B, C representing the movement distances of the movable members 41 to 43 each exhibit a steep rise, indicating that the corresponding movable members 41 to 43 moving along the second threaded sending portion 34, 36 of the lead screws 31, 32. In the graph, the rotation amount of the lead screws 31, 32 indicated by the single-dotted chain line $P_0$ corresponds to the base position of the lead screws 31, 32. A controller, or a CPU (not shown), controls the operational state of the drive motor 30 with reference to the rotation amount (the rotational angle) indicated by the single-dotted chain line $P_0$. If the rotation amount of the lead screws 31, 32 falls in the range $V_{open}$, which is illustrated at the left side of the single-dotted chain line $P_0$ of FIG. 15, it is indicated that the cap member 51 is located at the sealing position at which the cap member 51 seals the nozzle-forming surface 21*a* of the recording head 21. Meanwhile, the pressing piece 56 of the movable member 41 presses the lever member 70 of the air exposure valve device 58 so as to raise the valve bodies 66 to the opening positions.

The illustrated embodiment has the following advantages.

The flushing box 88 is movable between the receiving position, at which the flushing box 88 is located immediately below and opposed to the nozzle surface 21*a* of the recording head 21 stopped at the home position HP, and the non-receiving position spaced from the receiving position. It is thus unnecessary to fix the flushing box 88 in an area opposed to the home position HP with the printing area for printing on the paper sheet P arranged between the flushing box 88 and the home position HP. This eliminates the necessity of room for arranging the flushing box 88 in a fixed state in the body casing 11 of the printer 10. The space in the body casing 11 is thus correspondingly saved.

When located at the non-receiving position, the opening 88*a* of the flushing box 88 is closed by the seal plate 84. This effectively suppresses dryness and solidification of the waste ink absorbed in and retained by the liquid absorbing material 88*b* of the flushing box 88 through evaporation of the solvent.

The direction in which the flushing box 88 moves in association with movement of the movable members 43 is the front-and-rear direction, which is perpendicular to the movement direction of the carriage 16, or the left-and-right direction. This makes it unnecessary to ensure space in the body casing 11 for allowing the flushing box 88 to move in the movement direction of the carriage 16. The longitudinal dimension of the body casing 11 is thus prevented from being increased, which suppresses enlargement of the printer 10.

When located at the non-receiving position of FIG. 9A, the flushing box 88 is held in the vertical posture with the opening 88*a* facing laterally. The opening 88*a* of the flushing box 88 is thus sealed by the seal plate 84. Therefore, as viewed from above, the flushing box 88 occupies a relatively small space. Also in this regard, the size of the printer 10 is reduced.

When moving between the receiving position and the non-receiving position, the flushing box 88 pivots and switches between the horizontal posture and the vertical posture. This occurs through contact between the bottom surface and the leg portions 91 of the flushing box 88 and the width increasing stepped portions 95 of the support pillar portions 50*a* of the holder member 50. The flushing box 88 is thus allowed to easily and smoothly switch between the receiving position and the non-receiving position while moving.

The liquid absorbing material 88*b* is received in the flushing box 88 that is shaped like a box with a closed bottom. The waste ink received by the flushing box 88 through the opening 88*a* is thus absorbed in and retained by the liquid absorbing material 88*b* regardless of movement of the flushing box 88. This suppresses contamination of the interior of the body casing 11.

The waste ink is drawn and drained from the flushing box 88 through the waste ink tube 89 through actuation of the suction pump 29. This maintains the performance of the flushing box 88 for receiving the waste ink in a desirable state.

When the flushing box 88 is located at the non-receiving position, the seal plate 84 closes the opening 88*a* of the flushing box 88. The seal plate 84 is urged by the urging force of the coil springs 86 toward the flushing box 88. The flushing box 88 is thus reliably sealed by the seal plate 84 at the opening 88*a*. Accordingly, evaporation of the waste ink is effectively suppressed.

The lead screws 31, 32 and the movable members 43, which advance and retreat along the directions of the axes S of the corresponding lead screws 31, 32, form a mechanism for moving the flushing box 88, which is the liquid receiver. The flushing box 88 is thus easily moved through simple operation, or rotation of the lead screws 31, 32.

In rotation of the lead screws 31, 32, the flushing box 88 is rapidly moved in association with movement of the movable members 43 along the second threaded sending portions 34, 36, while changing the posture of the flushing box 88.

To allow the seal plate 84 to easily block the opening 88*a*, the drive force of the drive motor 30 by which the flushing box 88 is moved is provided separately from the drive force of the carriage motor 19 by which the carriage 16 is moved. The carriage motor 19 is prevented from receiving excessive load unlike, for example, a case in which the seal plate 84 is pressed and moved by the carriage 16 separately from the opening 88*a* of the flushing box 88. This ensures smooth movement of the carriage 16 and maintains ink ejection onto the paper sheet P in a desirable state.

The illustrated embodiment may be modified to the following embodiments.

The flushing box 88 may be held in a state associating with the movable members 41, 42, other than the movable members 43. In this case, the flushing box 88 is moved in association with movement of the movable members 41, 42.

The maintenance unit 24 may be provided at the right end of the space in the body casing 11 with the lead screws 31, 32 arranged along the left-and-right direction. In this case, when the lead screws 31, 32 rotate, the flushing box 88 is moved in the movement direction of the carriage 16, or the left-and-right direction.

The drive force transmitting members, which are formed by the lead screws 31, 32, may be slidable members or shafts that slide along the direction of the axes S. In this case, at least one movable member is secured to each of the shafts at a predetermined interval in the longitudinal direction of the shaft. It is preferred that a plurality of driven members are operated when the movable members are moved through movement of the shafts and allowed to associate with the driven members.

The threaded groove 47 of the lead screw 31 and that of the lead screw 32 may be spiral grooves with the same pitch.

Each movable member may include a nut member in which a female threaded bore to engage with the corresponding lead screws 31, 32 is provided. In this case, the female threaded bore is an engagement portion.

The coil springs 86 may be omitted.

The posture change inducing portion may be an upper end surface of each support pillar portion 50*a* of the holder member 50, which has a height and a shape corresponding to the height and the shape of each width increasing stepped portion 95.

The posture change inducing portion may be a guide plate having an arcuate guide groove with which each pin portion 92 of the flushing box 88 is engaged.

The waste liquid tube 89 does not necessarily have to be connected to the flushing box 88.

When located at the non-receiving position, the flushing box 88 may be held in a posture intermediate between the vertical posture and the horizontal posture or the horizontal posture. In these postures, the opening 88*a* of the flushing box 88 is closed by the seal plate 84.

The flushing box 88 may be operated in association with a specific lead screw provided separately from the lead screws 31, 32 through a movable member. The lead screw extends in the movement direction of the carriage 16. In this case, it is preferred that a drive source separate from the carriage motor 19 is provided for driving the lead screw to rotate.

The printer 10 may be an off-carriage type inkjet printer, other than the on-carriage type inkjet printer in which the ink cartridge 23 is mounted in the carriage 16.

The liquid ejection apparatus may be any suitable type other than the printer 10 that ejects ink. For example, the liquid ejection apparatus may be a printing device including a fax or a copier; a liquid ejection apparatus that ejects liquid such as electrode material or color material used in the manufacture of liquid crystal displays, EL displays, and surface emitting displays; a liquid ejection apparatus that ejects bioorganic matter used in the manufacture of biochips; or a liquid ejection apparatus as a precision pipette. Further, liquid other than the ink may be ejected by the liquid ejection apparatus.

The present examples and embodiments are to be considered as illustrative and not restrictive and the invention is not to be limited to the details given herein, but may be modified within the scope and equivalence of the appended claims.

What is claimed is:

1. A liquid ejection apparatus comprising:

a liquid ejection head having a nozzle surface, the nozzle surface including a nozzle opening, the liquid ejection head ejecting a liquid from the nozzle surface;

a liquid receiver having an opening provided in correspondence with the nozzle surface of the liquid ejection head, the liquid receiver being capable of receiving the liquid ejected as a waste liquid from the nozzle opening of the liquid ejection head through the opening of the liquid receiver;

a liquid receiver movement mechanism that moves the liquid receiver between a receiving position at which the opening of the liquid receiver opposes the nozzle surface of the liquid ejection head and a non-receiving position spaced from the receiving position;

a lid body arranged at the non-receiving position, the lid body contacting the liquid receiver in such a manner as to close the opening of the liquid receiver after the liquid receiver is moved to the non-receiving position by the liquid receiver movement mechanism; and an urging member that urges the lid body toward the liquid receiver while the lid body closes the opening of the liquid receiver in the non-receiving position.

2. The apparatus according to claim 1 further comprising a carriage that reciprocates, the liquid ejection head being mounted in the carriage, the liquid receiver movement mechanism moving the liquid receiver in a direction perpendicular to the direction in which the carriage reciprocates.

3. The apparatus according to claim 1, wherein, when located at the non-receiving position, the liquid receiver is held in a substantially vertical posture with the opening of the liquid receiver facing laterally.

4. The apparatus according to claim 1, further comprising a posture change inducing portion arranged on a movement path of the liquid receiver between the receiving position and the non-receiving position, the posture change inducing portion changing a posture of the liquid receiver by contacting the liquid receiver that is being moved by the liquid receiver movement mechanism, wherein the posture change inducing portion changes the posture of the liquid receiver from a horizontal posture to a vertical posture when the liquid receiver moves from the receiving position to the non-receiving position, and wherein the posture change inducing portion changes the posture of the liquid receiver from the vertical posture to the horizontal posture when the liquid receiver moves from the non-receiving position to the receiving position.

5. The apparatus according to claim 1, wherein the liquid receiver accommodates a liquid absorbing material.

6. The apparatus according to claim 1, further comprising a suction drainage device and a liquid discharge line connected to the liquid receiver, wherein liquid drawn from the liquid receiver is discharged to the liquid discharge line through actuation of the suction drainage device.

7. A liquid ejection apparatus comprising:

a liquid ejection head having a nozzle surface, the nozzle surface including a nozzle opening, the liquid ejection head ejecting a liquid from the nozzle surface;

a liquid receiver having an opening provided in correspondence with the nozzle surface of the liquid ejection head, the liquid receiver being capable of receiving the liquid ejected as a waste liquid from the nozzle opening of the liquid ejection head through the opening of the liquid receiver;

a liquid receiver movement mechanism that moves the liquid receiver between a receiving position at which the opening of the liquid receiver opposes the nozzle surface of the liquid ejection head and a non-receiving position spaced from the receiving position; and a lid body arranged at the non-receiving position, the lid body contacting the liquid receiver in such a manner as to close the opening of the liquid receiver after the liquid receiver is moved to the non-receiving position by the liquid receiver movement mechanism, wherein the liquid receiver movement mechanism further includes:

a drive force transmitting member that operates at a position in a horizontal direction between the receiving position and the non-receiving position through generation of a drive force; and a movable member that moves within a range in a horizontal direction between the receiving position and the non-receiving position through operation of the drive force transmitting member, wherein the liquid receiver is maintained in a state associating with the movable member and thereby moves between the receiving position and the non-receiving position in association with movement of the movable member.

8. The apparatus according to claim 7, wherein the drive force transmission member comprises an elongated bar-like sending member, wherein the sending member is rotated about its axis by the drive force, wherein the movable member has an engagement portion that is arranged to engage with the threaded portion of the sending member, and wherein the movable member is moved along the longitudinal direction of the sending member through the engagement portion guided by the threaded portion when the sending member rotates.

9. The apparatus according to claim 8, wherein the threaded portion has a first threaded portion and a second threaded portion, and wherein the pitch of the first threaded portion is smaller that the pitch of the second threaded portion.

10. A liquid ejection apparatus comprising:

a liquid ejection head having a nozzle surface, the nozzle surface including a nozzle opening, the liquid ejection head ejecting a liquid from the nozzle surface;

a liquid receiver having an opening provided in correspondence with the nozzle surface of the liquid ejection head, the liquid receiver being capable of receiving the liquid ejected as a waste liquid from the nozzle opening of the liquid ejection head through the opening of the liquid receiver;

a liquid receiver movement mechanism that moves the liquid receiver between a receiving position at which the opening of the liquid receiver opposes the nozzle surface of the liquid ejection head and a non-receiving position spaced from the receiving position;

a lid body arranged at the non-receiving position, the lid body contacting the liquid receiver in such a manner as to close the opening of the liquid receiver after the liquid receiver is moved to the non-receiving position by the liquid receiver movement mechanism; and a carriage that reciprocates, wherein the liquid ejection head is mounted in the carriage, and wherein the liquid receiver movement mechanism causes the liquid receiver to move horizontally in a direction perpendicular to the reciprocating direction of the carriage.

11. The liquid ejection apparatus according to claim 10, wherein the carriage moves in left-and-right direction of the liquid ejection apparatus and the liquid receiver moves in a front-and-back direction of the liquid ejection apparatus.

* * * * *

UNITED STATES PATENT AND TRADEMARK OFFICE

CERTIFICATE OF CORRECTION

PATENT NO. : 7,726,772 B2
APPLICATION NO. : 11/655210
DATED : June 1, 2010
INVENTOR(S) : Taisuke Yamamoto It is certified that error appears in the above-identified patent and that said Letters Patent is hereby corrected as shown below:

On title page, item (75) should read: Taisuke Yamamoto, ~~Suwa (JP)~~ Shiojiri-shi (JP)

Signed and Sealed this

Twenty-fourth Day of August, 2010

David J. Kappos

David J. Kappos
*Director of the United States Patent and Trademark Office*